US010660456B2

(12) United States Patent
Snyder et al.

(10) Patent No.: US 10,660,456 B2
(45) Date of Patent: May 26, 2020

(54) AUTOMATED HYGIENIC UTENSIL DISPENSER

(71) Applicant: Max Packaging, Attalla, AL (US)

(72) Inventors: Greg Snyder, Novato, CA (US); Dennis Ashley, Attalla, AL (US); Rickey Burns, Attalla, AL (US); Gary McFarland, Attalla, AL (US); Rhys McFarland, Attalla, AL (US)

(73) Assignee: Gadsden Coffee Company, Attalla, AL (US)

( * ) Notice: Subject to any disclaimer, the term of this patent is extended or adjusted under 35 U.S.C. 154(b) by 0 days.

(21) Appl. No.: 16/236,476

(22) Filed: Dec. 29, 2018

(65) Prior Publication Data

US 2019/0133340 A1 May 9, 2019

Related U.S. Application Data

(62) Division of application No. 15/489,531, filed on Apr. 17, 2017, now Pat. No. 10,201,237.

(51) Int. Cl.

| | |
|---|---|
| ***A47F 1/10*** | (2006.01) |
| ***A47F 1/04*** | (2006.01) |
| ***B65D 83/04*** | (2006.01) |

(52) U.S. Cl.

CPC ..... *A47F 1/10* (2013.01); *A47F 1/04* (2013.01); *A47F 1/106* (2013.01); *B65D 83/04* (2013.01); *A47F 2001/103* (2013.01)

(58) Field of Classification Search

CPC .... A47F 1/10; A47F 1/04; A47F 1/106; A47F 2001/103; B65D 83/04

USPC ..... 206/155, 176; 53/473; 221/22, 1, 197, 221/312 A, 289; 219/136, 98, 99

See application file for complete search history.

(56) References Cited

U.S. PATENT DOCUMENTS

| | | | | | |
|---|---|---|---|---|---|
| 3,118,565 | A * | 1/1964 | Chappory | A47F 1/085 | 221/92 |
| 3,180,489 | A * | 4/1965 | McGinn | B65D 71/00 | 206/340 |
| 3,998,238 | A * | 12/1976 | Nigro | G07D 1/08 | 221/279 |
| 4,338,714 | A * | 7/1982 | Powderly | B21J 15/34 | 29/433 |
| 4,346,804 | A * | 8/1982 | Powderly | B21J 15/34 | 206/206 |
| 4,570,796 | A * | 2/1986 | Groom | B65D 83/0847 | 206/434 |
| 5,163,580 | A * | 11/1992 | Beach | B65B 15/00 | 206/445 |
| 6,112,944 | A * | 9/2000 | Van Hoorn | B65G 59/062 | 221/190 |
| 6,176,383 | B1 * | 1/2001 | Lafond | B65D 1/34 | 206/499 |

(Continued)

*Primary Examiner* — Rakesh Kumar

(74) *Attorney, Agent, or Firm* — Indrajana Law Group, a PLC

(57) ABSTRACT

A hygienic automatic electric utensil dispenser for use in eating establishments such as hospitals, schools, or other areas where large number of people are eating food in a central area. The dispenser can be refilled using prepackaged stacked plastic utensil in a self-sealing plastic bags without the user ever touching the utensil during the refilling process. The dispenser delivers the utensil in a sanitary method using a plurality of sensors.

5 Claims, 23 Drawing Sheets

(56) References Cited

U.S. PATENT DOCUMENTS

| | | | | |
|---|---|---|---|---|
| 6,908,022 | B2 * | 6/2005 | Schmitz | B25C 5/1693 227/119 |
| 7,507,379 | B2 * | 3/2009 | Hunnell | B01L 9/52 206/460 |
| 9,113,729 | B2 * | 8/2015 | Righetti | A47F 1/10 |
| 10,010,195 | B2 * | 7/2018 | Smith | A47F 1/10 |
| 2010/0327046 | A1 * | 12/2010 | Mohda | B65D 75/5844 229/87.07 |
| 2015/0360812 | A1 * | 12/2015 | Gerson | B01D 29/085 206/459.5 |

* cited by examiner

AUTOMATED HYGIENIC UTENSIL DISPENSER

CROSS REFERENCE TO RELATED APPLICATIONS

This divisional application claims priority to the Non-Provisional application Ser. No. 15/489,531 filed on Apr. 17, 2017, which in turn claims priority to Non-Provisional application Ser. No. 14/868,117 filed on Sep. 28, 2015 and provisional Application No. 62/057,630, filed on Sep. 30, 2014.

The specifications of application Ser. Nos. 15/489,531, 14/868,117 and 62/057,630 are herein incorporated by reference.

STATEMENT REGARDING FEDERALLY SPONSORED RESEARCH AND DEVELOPMENT

None.

FIELD OF THE INVENTION

The present application relates to automatic disposable utensil dispenser, specifically, an automatic disposable utensil dispenser wherein said utensil can be hygienically handled from the factory all the way to the end user who uses the utensil.

BACKGROUND

Disposable utensil, for example, plastic spoons, forks, knives and "sporks," (e.g., a combination of a spoon and a fork), are frequently used in informal restaurant settings and are provided for use with "take out" restaurant food. To ensure that this utensil is provided in a hygienic form, it is often purchased by a restaurant or other facility pre-sealed in a pouch. A napkin and condiments i.e., salt and pepper, and for example, may be included in the pouch. Such pouches are generally more expensive than the individual utensils due to the processing and materials necessary to form the pouches. Also, these pouches may provide more utensil or condiments than the user needs and, as such, may be wasteful.

A variety of dispensers have been proposed as an alternative to loose or pouch-packaged utensil. Previously known dispensers, however, suffer at least the perception of sanitary and hygienic concerns by many users. For example, when utensil is dispensed into a collection tray, the tray of the dispenser may become soiled as users repeatedly touch the tray while collecting dispensed utensil. Also, the handles, knobs or other actuators of manually operated dispensers are touched by multiple users, and must be regularly cleaned in order to maintain safe hygiene levels. Additionally, another point of contamination may occur when a person who is loading the dispenser accidentally or purposely touches the utensil during the reloading process. Previously known dispensers also often lack the degree of convenience and economy in operation that would be desirable.

Accordingly, a continual need exists for improved utensil dispensers that are particularly useful in dispensing disposable utensil in a hygienic, convenient, economical and non-wasteful manner.

SUMMARY

The present invention relates to dispensers for disposable utensil and method of hygienically dispensing utensil.

In one embodiment, a utensil dispenser comprises a storage chamber adapted to retain a plurality of utensil therein; a dispenser for sequentially ejecting the plurality of utensil from the storage chamber; an actuator for driving the dispenser; a sensor for triggering the actuator in response to a user triggering the dispenser.

In one embodiment, a utensil dispenser comprises a storage chamber adapted to retain a plurality of utensil therein, the storage chamber comprising a storage chute for retaining the plurality of utensil in a stacked array; a touchless sensor for generating a signal in response to a user; an electronic controller adapted to receive the signal from the touchless sensor and trigger the automated dispenser mechanism in response thereto; and an automated dispense mechanism in operative communication with the electronic controller, the automated dispense mechanism adapted to discharge at least a portion of one of the plurality of utensil pieces from the storage chute upon triggering by the electronic controller.

In one embodiment, a utensil dispenser comprises a storage chute for containing a plurality of utensil, each piece of utensil having a handle end and a food-contact end; and a dispense mechanism for sequentially dispensing the utensil one at a time from the storage chute, by presenting the handle end of a dispensed utensil for retrieval by a user and retaining the food-contact end of the dispensed utensil until released upon retrieval by the user.

The dispensing mechanism comprises an upper plate, said upper plate having a plurality of Pressure Pads 202 that apply pressure perpendicular to the vertical stack of utensil; a middle plate having a plurality of tracks, said middle plate connected to a motor; a lower plate, said lower plate having a plurality of dispensing teeth, where said teeth are used to separate a single piece of utensil from the vertical stack down to the dispensing chute.

In one embodiment, the vertical utensil stack is loaded into the dispenser in its original factory packaging, and the person loading the utensil removes the packaging once the vertical stack is properly secured in the dispensing silo.

BRIEF DESCRIPTION OF DRAWINGS

These and other features, aspects, and advantages of the present invention will become better understood with regard to the following descriptions, appended claims and accompanying drawings where:

REFERENCE NUMBER INDEX

100—Utensil dispenser
101—Top loading door
102—Utensil indicator window
103—Locking Mechanism
104—Front door
105—Removable panel
106—Dispensing port
107—Moveable wall mount
108—Power and selector switch
110—Internal power source
111—Sliding weight
112—Sliding weight track
113—Hands free sensor
114—Dispensing LED
115—Low utensil IR emitter
116—Low utensil IR sensor
117—Empty utensil IR emitter
118—Empty utensil IR sensor
119—Chute
120—Moveable side wall
121—Rear column
122—Rear dispenser wall
123—Motor
125—Dispensing port sensor
200—Dispensing mechanism assembly
201—Tension spring
202—Pressure Pads
203—Dispensing teeth
204—Middle Plate
205—Upper plate
206—Lower plate
207—Motor Lever Plate
208—Actuator
209—Pins
210—Grooves
300—Utensil bag
301—Bag opening
302—Utensil stack
303—Utensil piece

DETAILED DESCRIPTION OF THE PREFERRED EMBODIMENT

Figure 1:
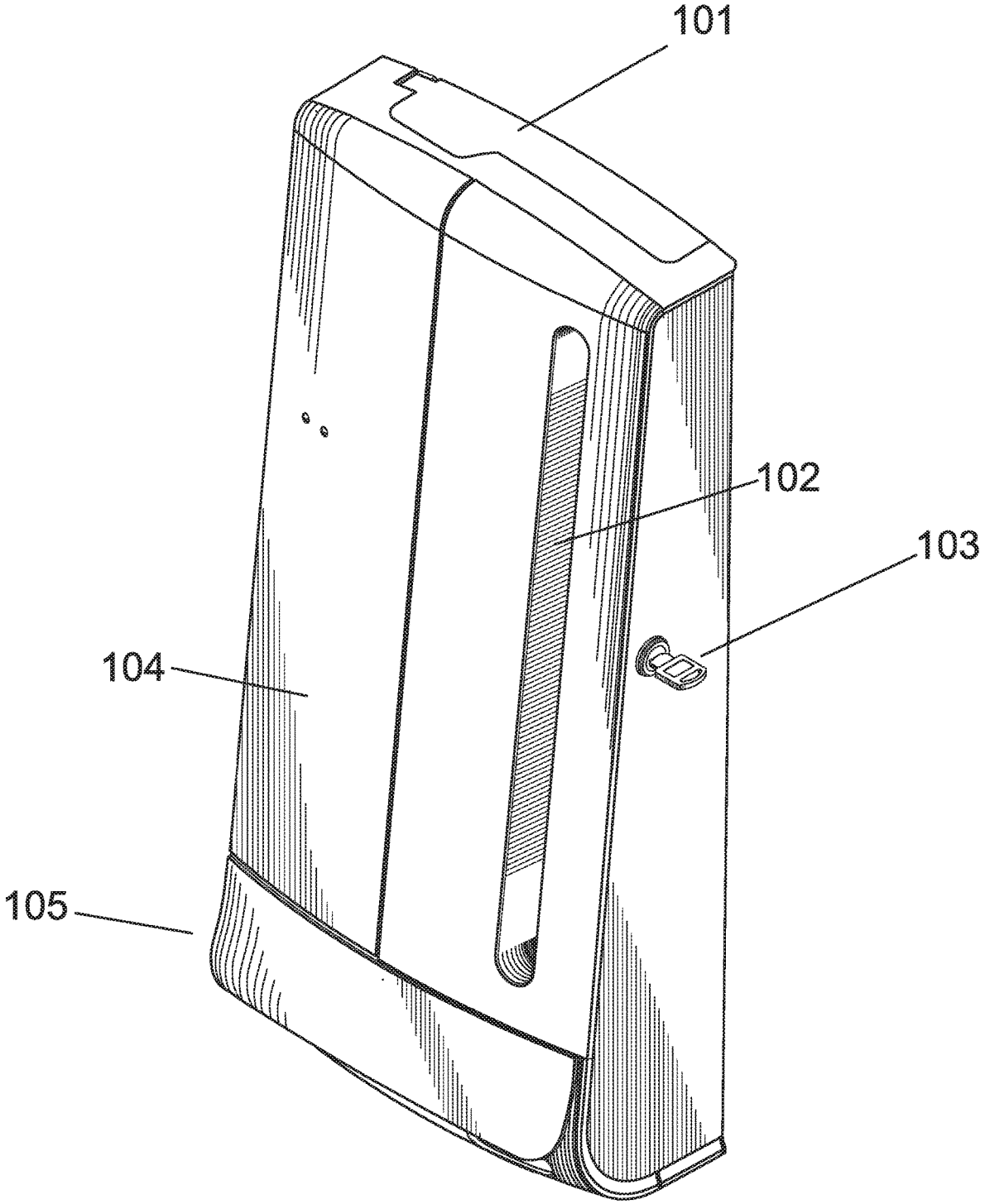
FIG. 01 shows a front perspective view of a hygienic utensil dispenser according to an exemplary embodiment of the present invention.

FIG. 01 shows a front perspective view of a hygienic utensil dispenser 100 according to an exemplary embodiment of the present invention. The hygienic utensil dispenser has a top loading door 101 that can be opened when the dispenser needs to be loaded with a utensil stack. A utensil indicator window 102 can be provided at the front door 104 of the dispenser, allowing users to see the amount of utensil left in the dispenser. A safety lock 103 can also be provided to protect the utensil inside from tampering and prevent the front door 104 from opening during operation.

Figure 2:
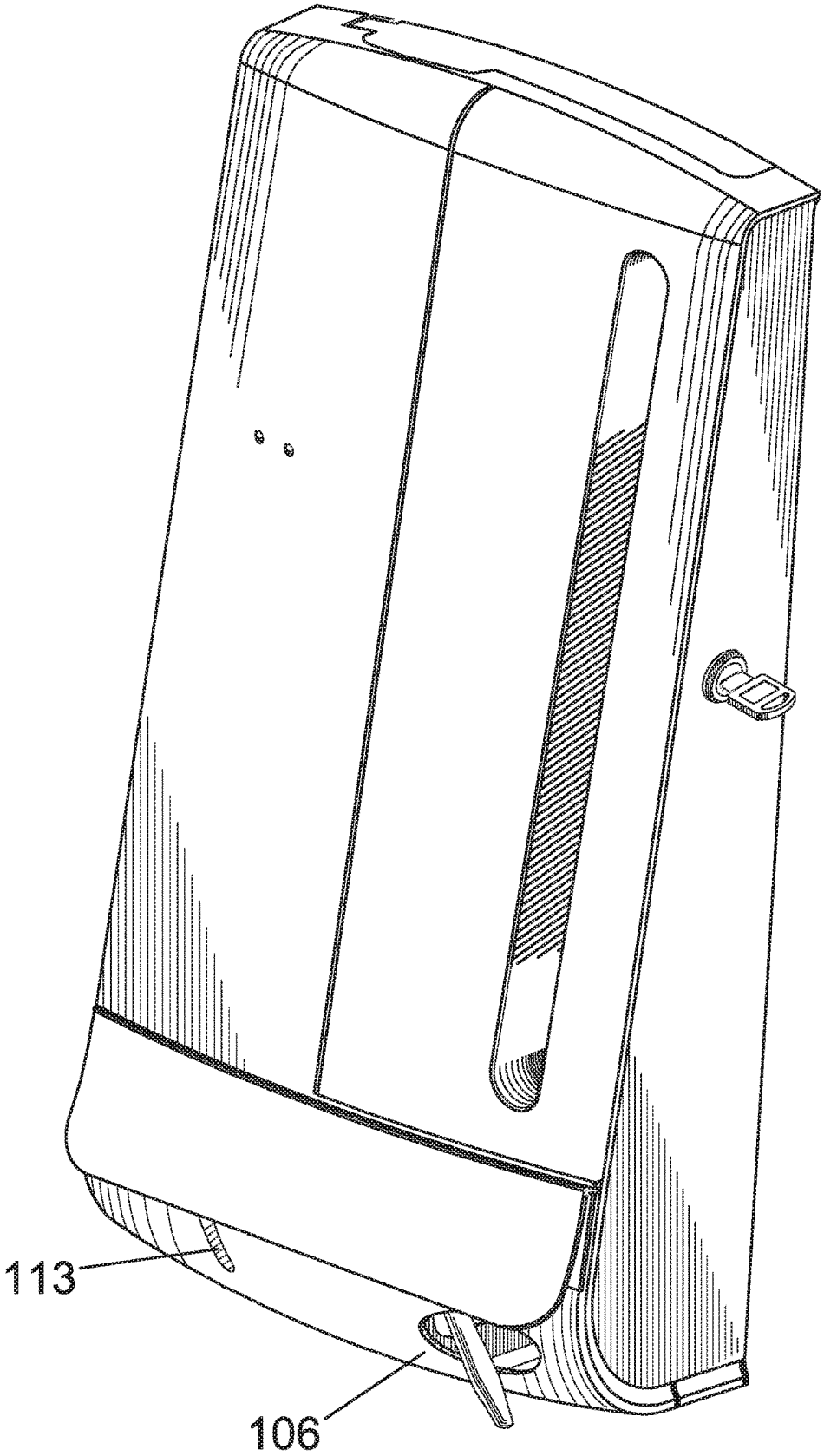
FIG. 02 shows a front perspective view of a hygienic utensil dispenser dispensing a piece of utensil.

FIG. 02 shows a front perspective view of a hygienic utensil dispenser dispensing a piece of utensil. When a utensil is dispensed through the dispensing port 106, the food-contacting portion/end of the utensil is protected within the dispenser while the utensil handle protrudes out from the dispenser at an angle for a user to take the utensil for use. The dispensing port is an exit only port, meaning that once a user pulls out a utensil, there is no way for the user to return the utensil back into the dispensing port. Instead, the user must discard the utensil if he or she decides to not use the utensil and not return the piece into the dispenser.

Figure 3:
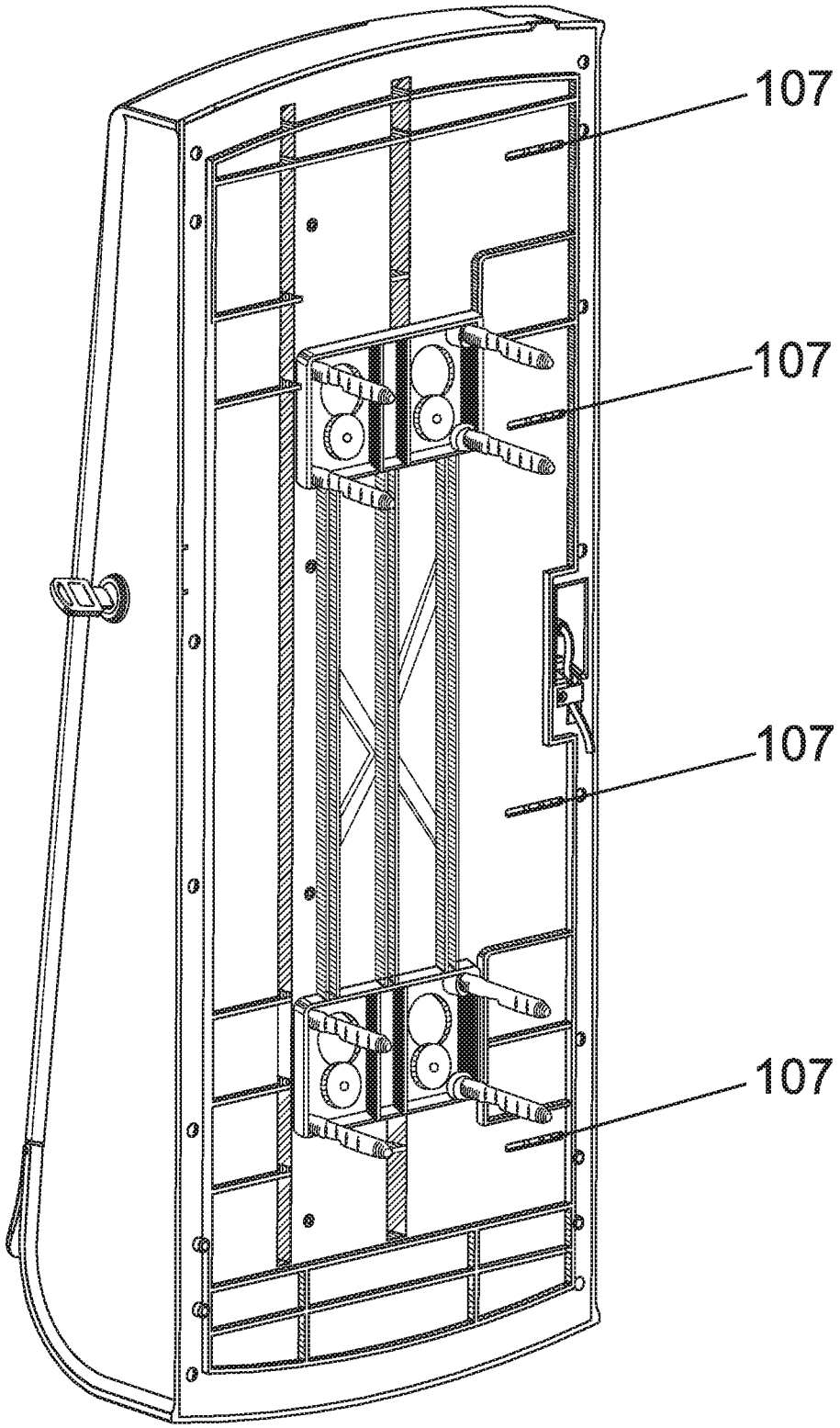
FIG. 03 shows a rear perspective view of a hygienic utensil dispenser.

FIG. 03 shows a rear perspective view of a hygienic utensil dispenser, showing the moveable wall mounts 107 from the external surface of the dispenser.

Figure 4:
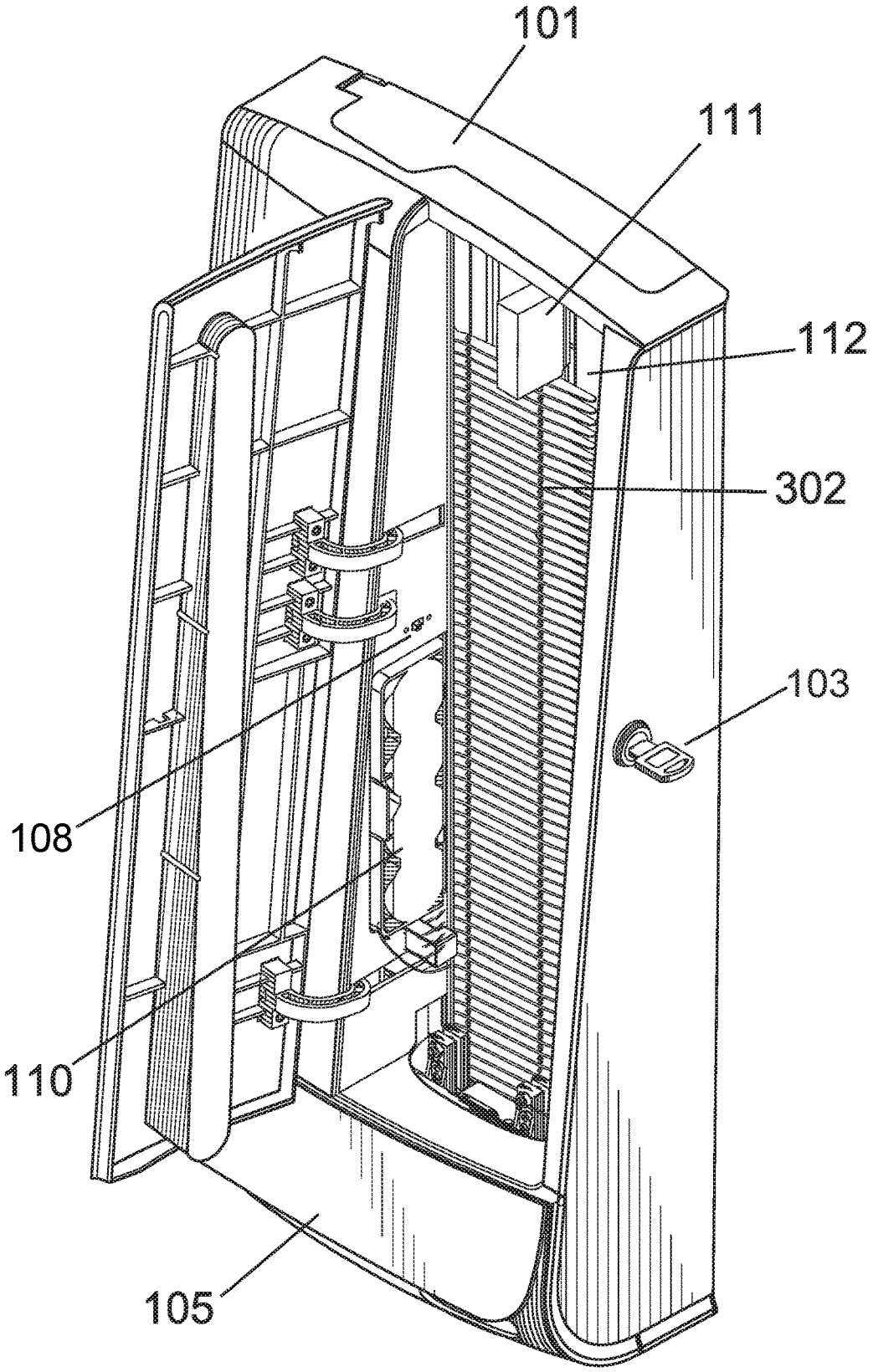
FIG. 04 shows a front perspective view of a hygienic utensil dispenser with its front door open, showing the internal workings of the dispenser.
Figures 6A, 6B:
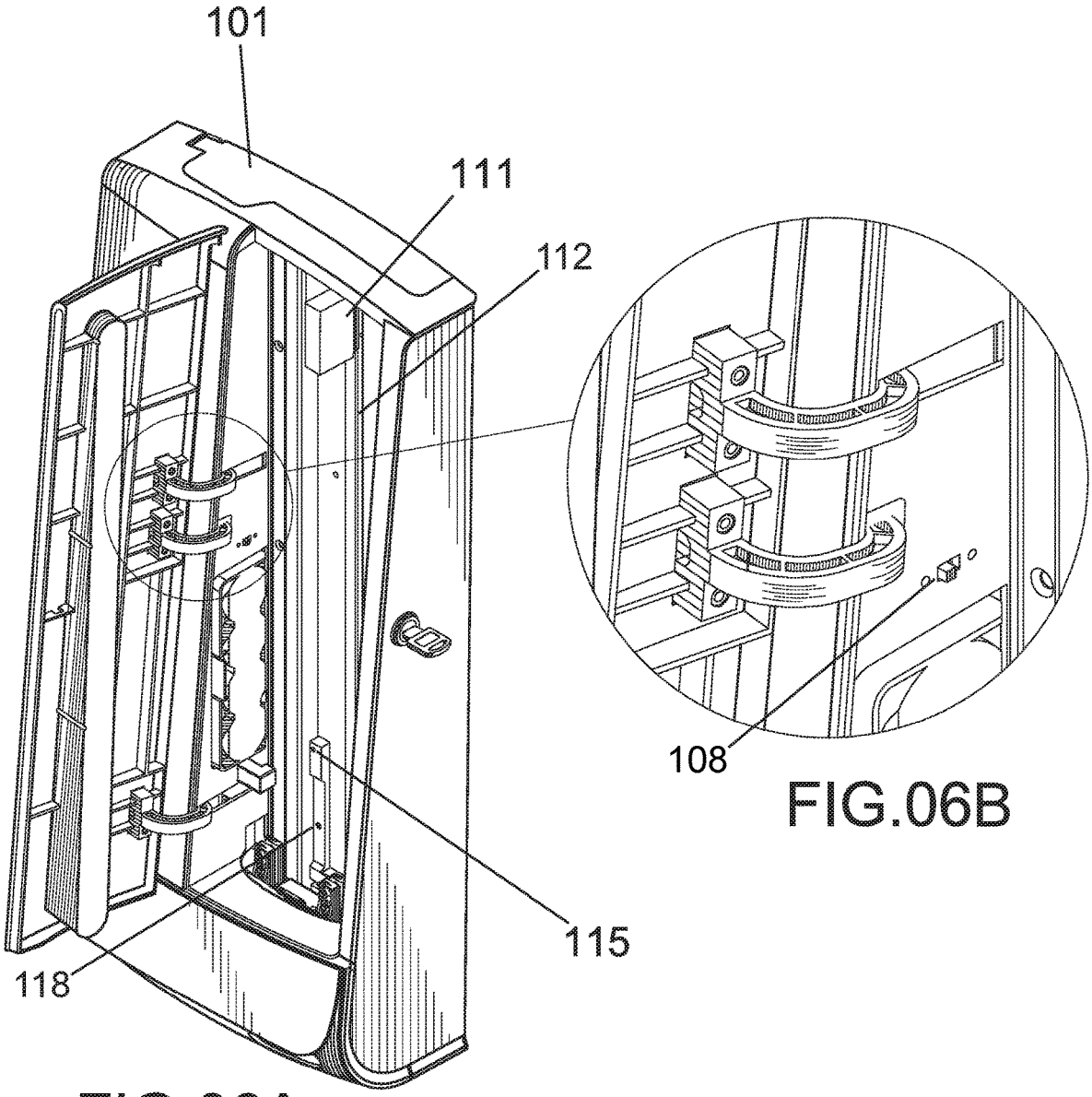
FIG. 06A show a perspective view of a hygienic utensil dispenser with its front door open, not loaded with utensil.
FIG. 06B is a zoomed in portion of FIG. 06A, showing detailed view on the power and selector switch and also allows for function selection on the internal part of a hygienic utensil dispenser.

FIG. 04 shows a front perspective view of a hygienic utensil dispenser 100 with its front door 104 open, showing the internal workings of the dispenser. A power and selector switch 108 is provided on the dispenser to turn the electronics on and off. FIGS. 06A and 06B show a better detail of the electronics control in one embodiment. A mode selector on the selector switch 108 can also be provided in one embodiment where the dispenser has several different dispensing modes available for use. An internal power source 110 is provided in the form of batteries. The batteries can be proprietary rechargeable or off the shelf standard cell sizes. It should be clear that a person having ordinary skill in the art can implement the embodiment using an external power source as a viable alternative to the internal power source.

In the preferred embodiment, at least two modes are offered: (1) the first mode dispenses a utensil piece when a user waves his or her hand near the dispensing port, or (2) an alternate mode where a utensil piece is dispensed each time the sensor within the dispensing port 106 determines that there is no utensil available at the dispensing port.

Figure 5A:
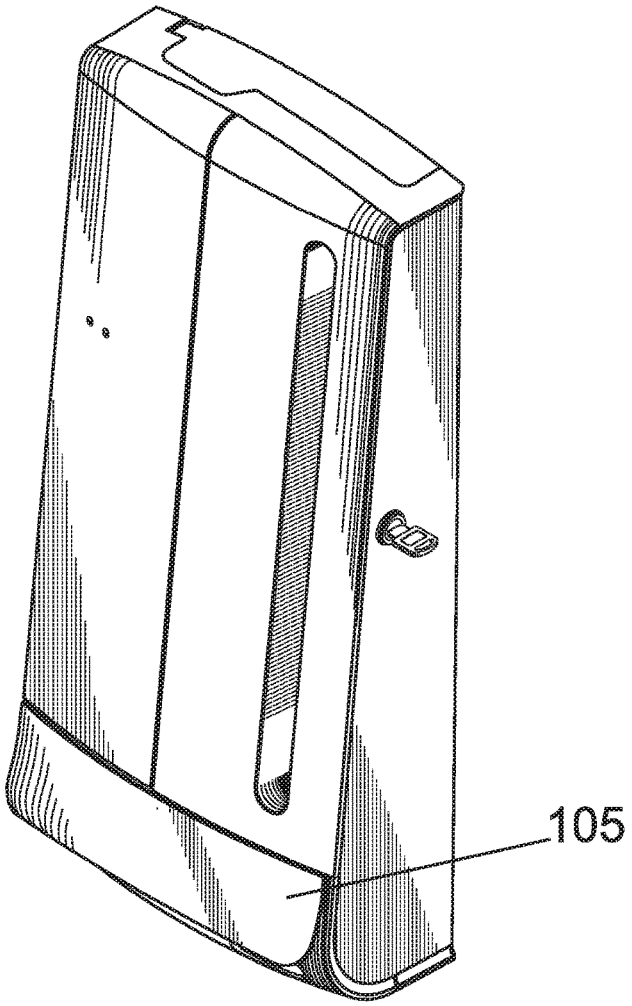
FIGS. 05A and 05B show front perspective views of a hygienic utensil dispenser with a removable panel.
Figure 5B:
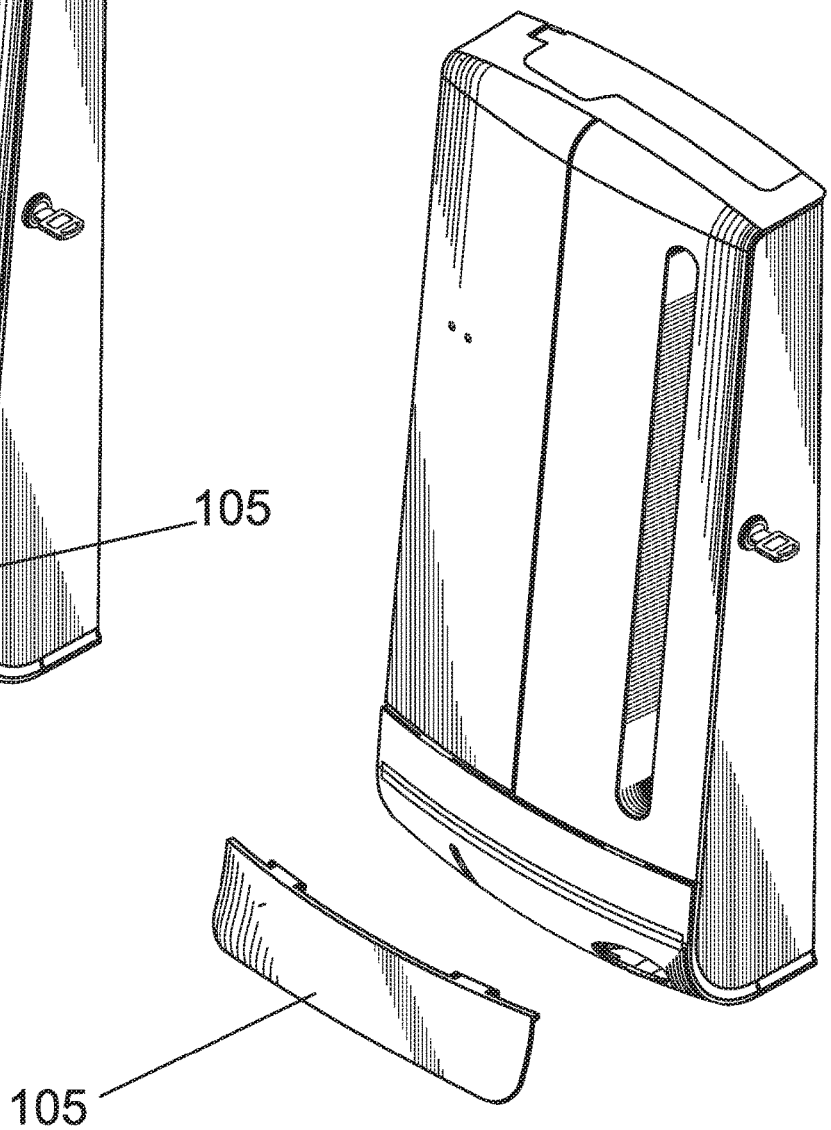

Looking at FIGS. 05A and 05B, front perspective views of a preferred embodiment with a removable panel 105. The removable panel functions as a dust/debris protector. In addition, the removable panel can hold printed labels and instructions as to the type of utensil available inside the dispenser.

A plurality of sensors are provided in the preferred embodiment to regulate the functions of the dispenser. A hands free sensor 113 and function LED 114 is provided for users to interact with the dispenser. Tripping the hands free sensor will trigger the dispensing mechanism, and a piece of utensil will be dispensed to the dispensing port. The function LED is also used to notify low count or no more utensil to be dispensed.

Figure 7:
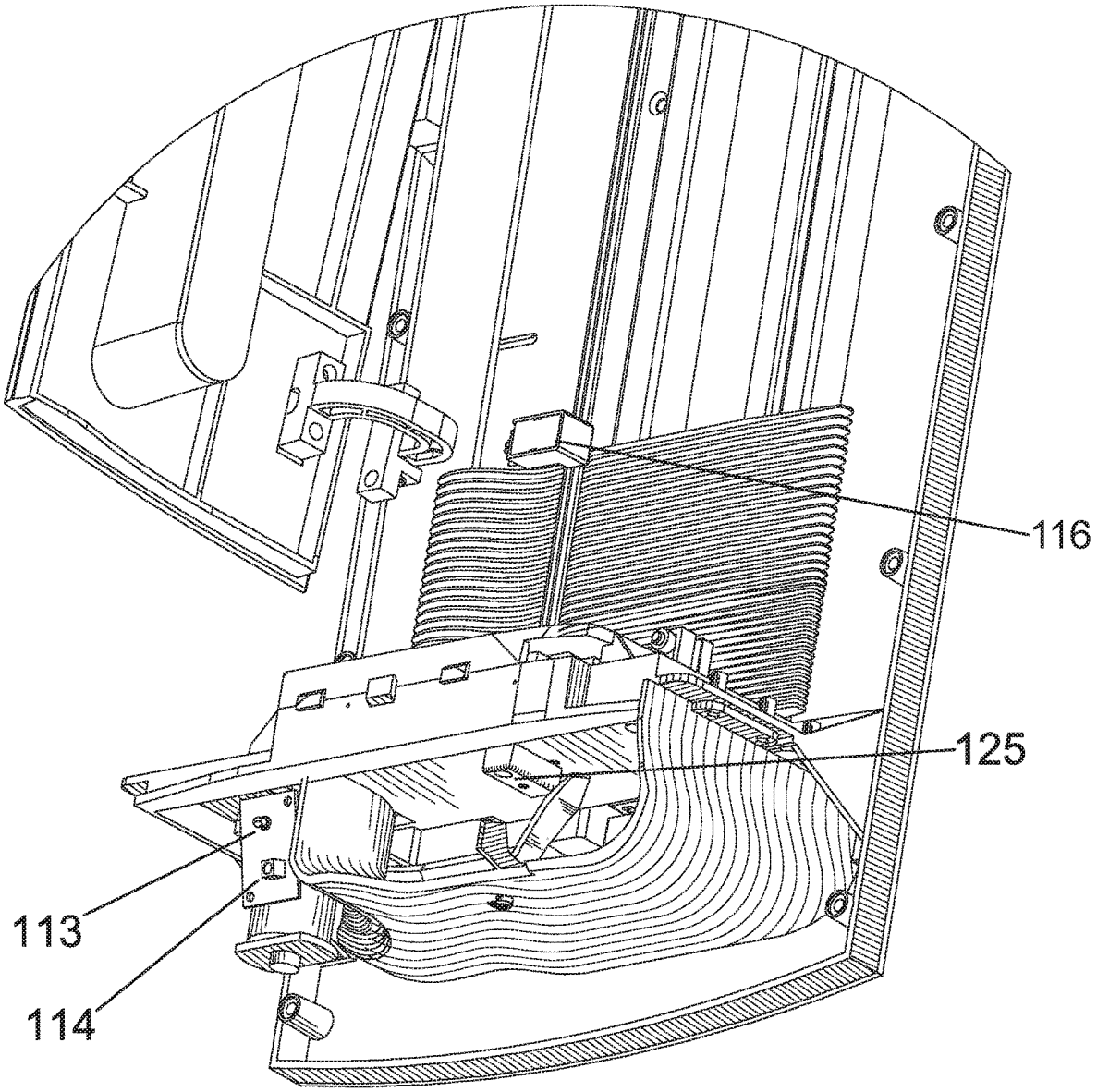
FIG. 07 is a front perspective internal view of the lower portion of a hygienic utensil dispenser.
Figure 9:
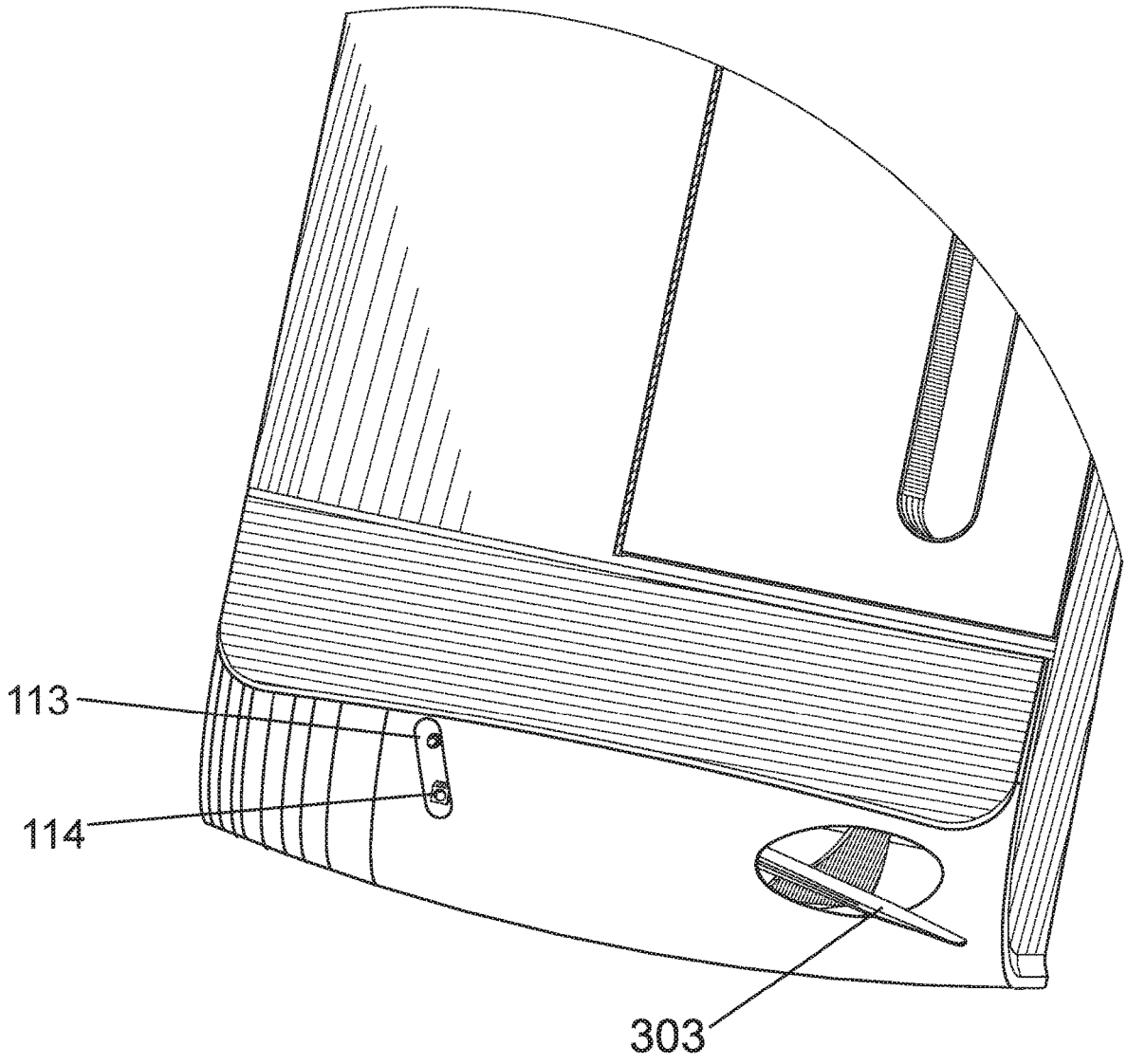
FIG. 09 is an enlarged front perspective external view of a hygienic utensil dispenser, showing the external sensors and utensil dispensing port.
Figure 10A:
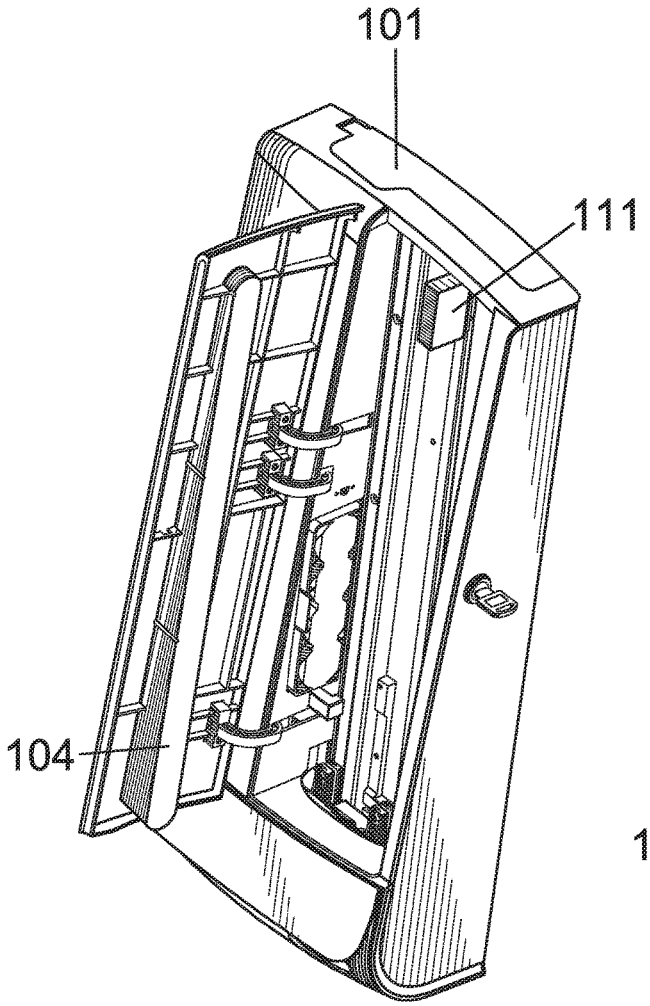
FIGS. 10A and B show the front perspective views of a hygienic utensil dispenser with the top loading door opened and closed, respectively.
Figure 10B:
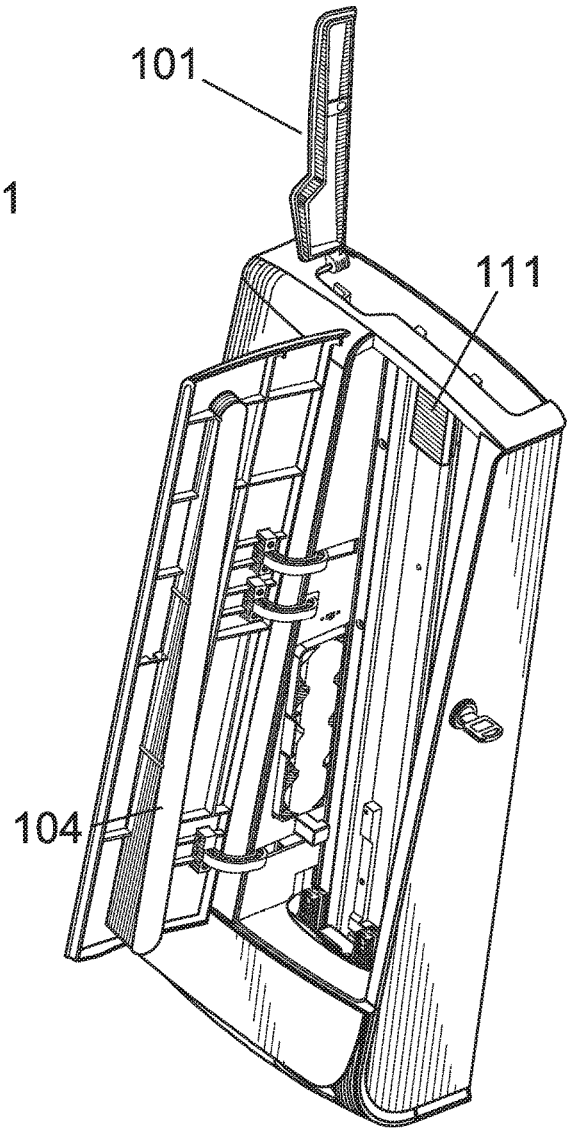
Figure 11:
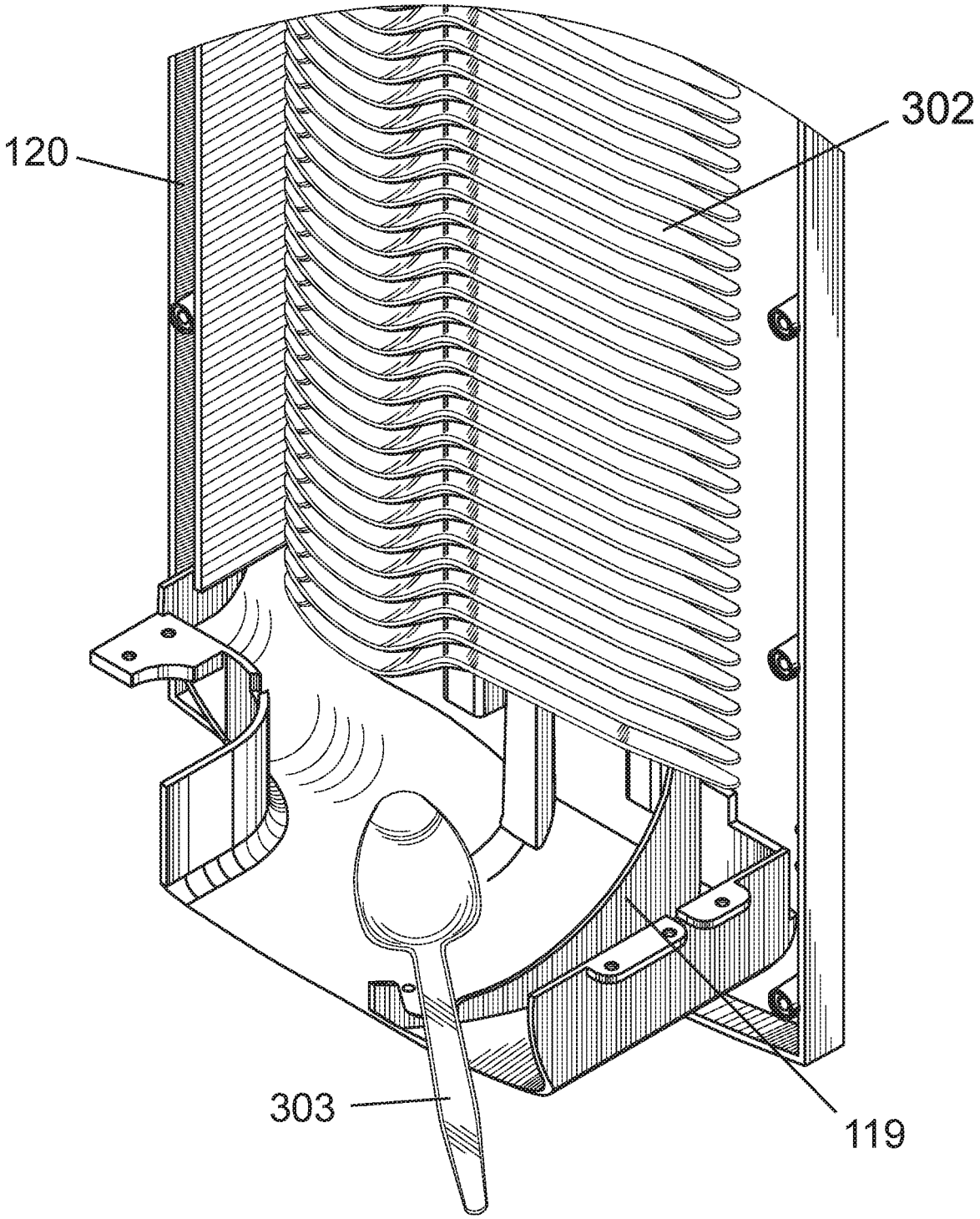
FIG. 11 is an enlarged front perspective internal view of a hygienic utensil dispenser showing detailed view on the chute and dispensing action.

In FIG. 07, the dispensing port can also be provided with a sensor to accommodate the second mode, wherein a utensil piece is dispensed each time a utensil piece is removed from the dispensing port, as part of the alternate dispensing mode described above. An alternate view of the ports can be seen in FIG. 09.

Figure 8:
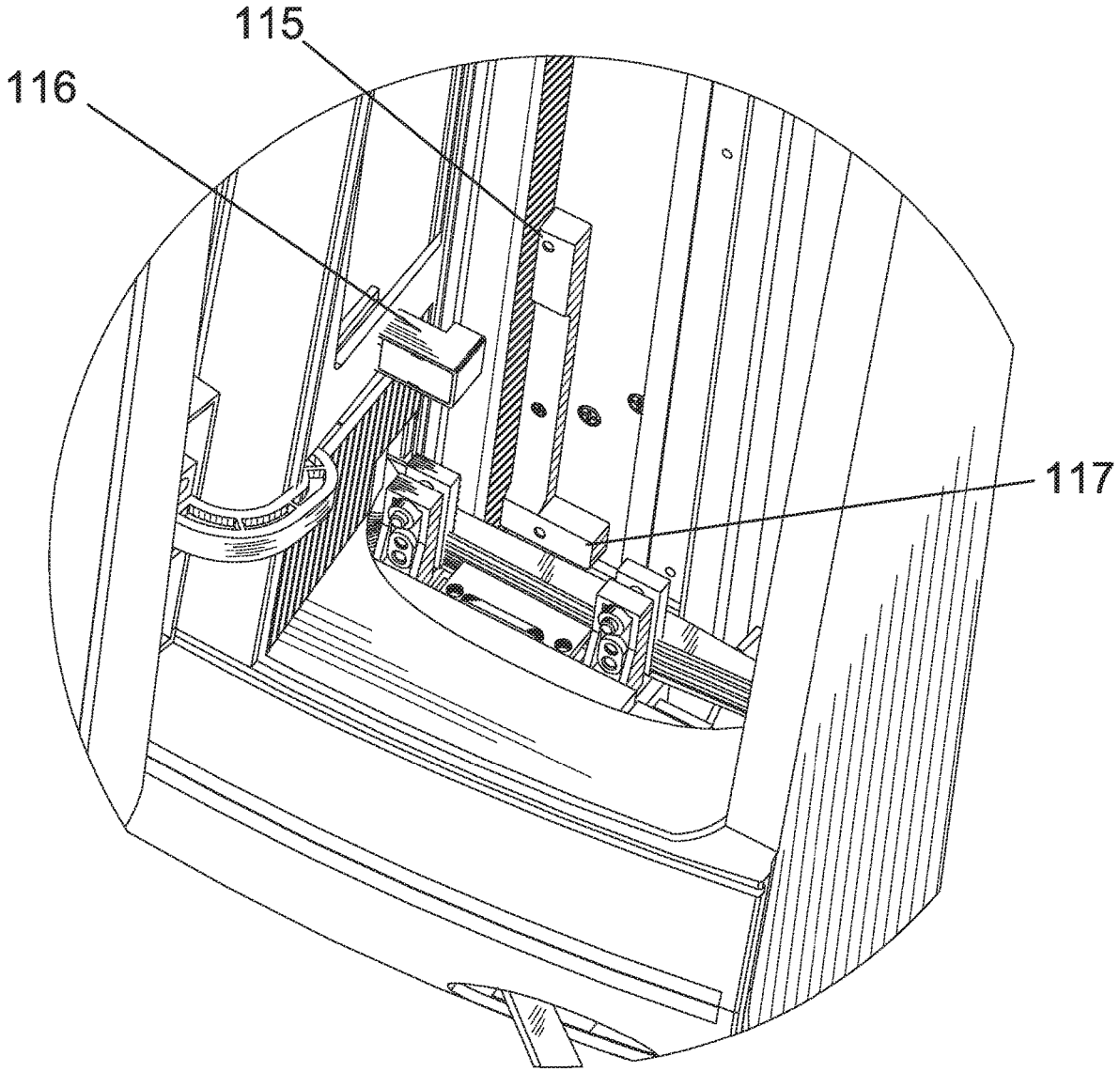
FIG. 08 is an enlarged front perspective internal view of a hygienic utensil dispenser; showing the various internal sensors in the dispenser.

A low utensil remainder sensor and a no utensil remained sensor are provided in the internal chamber of the preferred embodiment. FIG. 08 is an enlarged front perspective internal view of a hygienic utensil dispenser; showing the various internal sensors within the dispenser. In a version of the embodiment, the low utensil remainder sensor prevents the dispensing mechanism from dispensing any additional utensil until the dispenser has been refilled. Having a small amount of utensil instead of complete depletion allows the reloading process to be significantly easier, because the user does not have to realign the lower portion of the utensil stack with the dispensing mechanism. Instead, the user can simply top off the small utensil stack that is already properly aligned with the dispensing mechanism.

In an embodiment, a sliding weight 111 that travels along a vertical sliding weight track 112 can be provided inside the dispenser to further secure the utensil stack 302. The sliding weight 111 may be swiveled to the side to allow passage to the stacked cutlery when loading from the top. The sliding weight applies downward pressure to the utensil stack 302 to further minimize the possibility of a utensil piece dislodging itself from the stack during operation. At the top of the sliding weight track 112, a space is provided for the sliding weight to be set aside so a fresh utensil stack can be loaded through the top loading door 101 without the weight being in the way of the loading process.

Figure 12B:
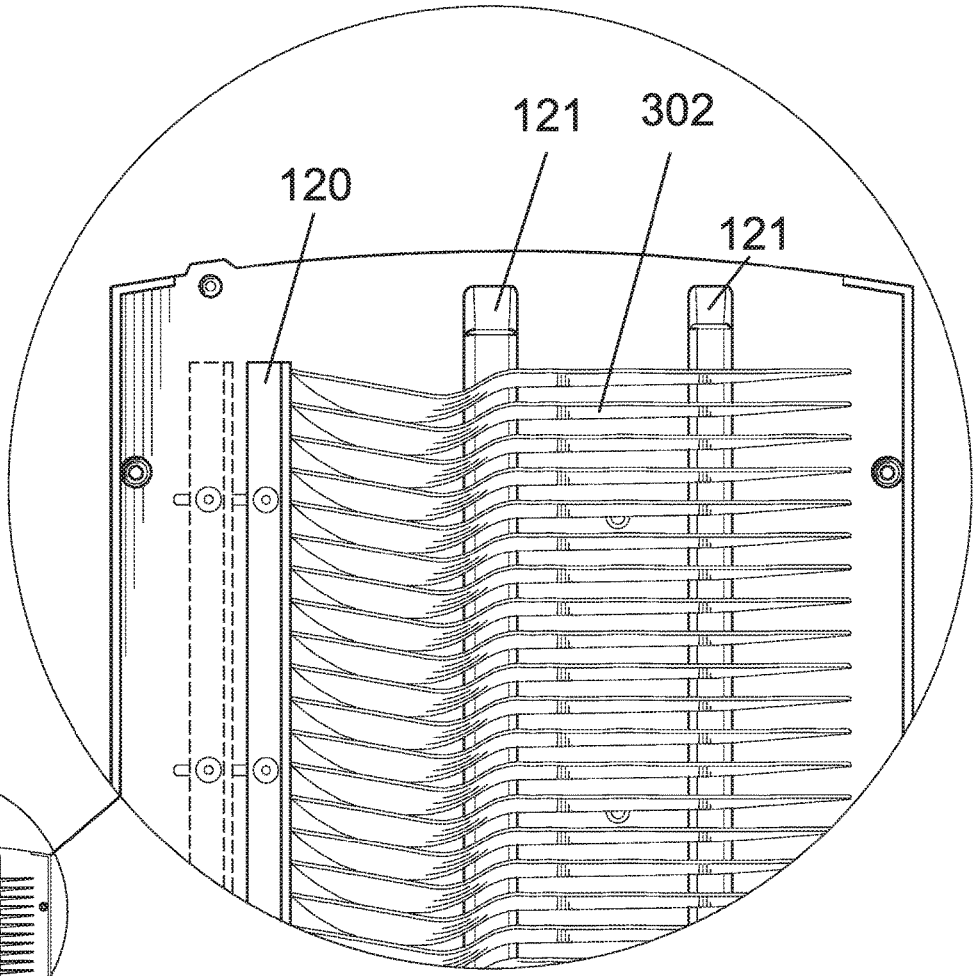
FIG. 12B is an enlarged view of FIG. 12A showing close detail of the moveable side wall mechanism.
Figure 12A:
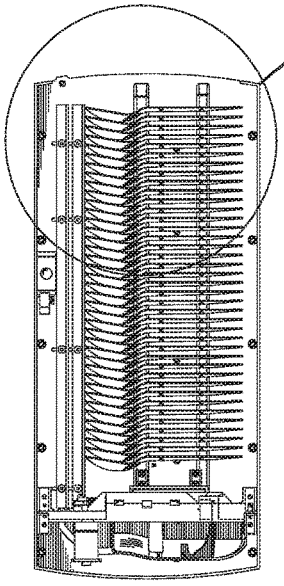
FIG. 12A is a front internal view of a hygienic utensil dispenser showing the moveable side wall to adjust for the different types of utensil to be dispensed.
Figure 13B:
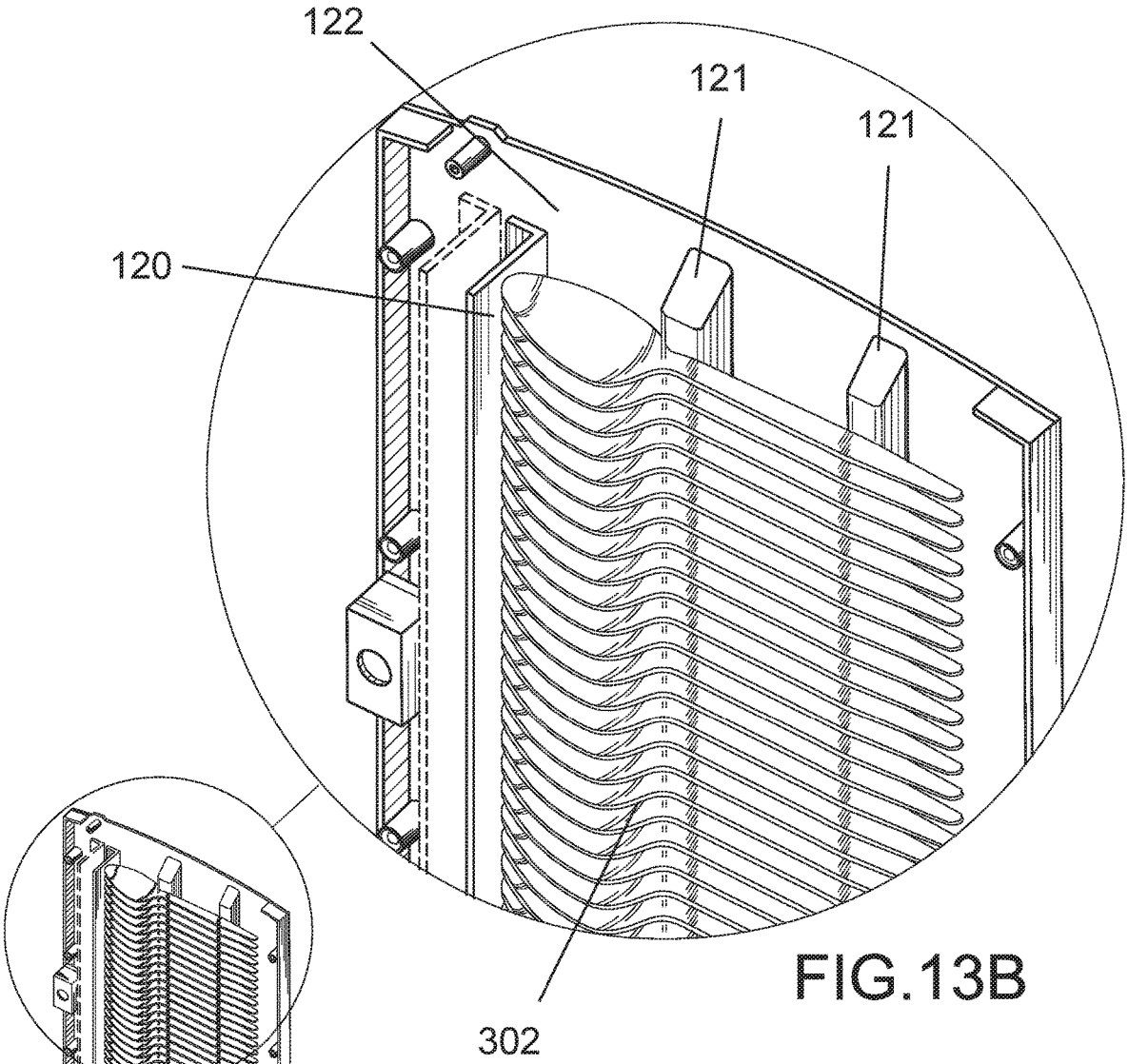
FIG. 13B is an enlarged view of FIG. 13A showing an alternate view of the internal of a hygienic utensil dispenser showing the movable side wall.
Figure 13A:
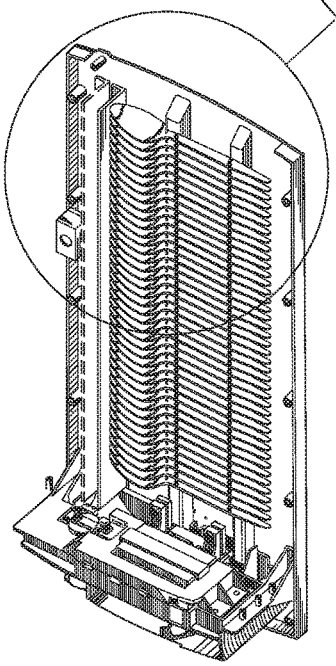
FIG. 13A is an alternate view of the internal of a hygienic utensil dispenser showing the moveable side wall.

A moveable side wall 120 can be adjusted to accommodate different types of utensil pieces. The moveable wall can be moved laterally to adjust for longer utensil pieces such as knives, or shorter pieces such as a soup spoon, is FIG. 12A is a front internal view of a hygienic utensil dispenser showing the moveable side wall to adjust for the different types of utensil to be dispensed, with FIG. 12B is an enlarged view of FIG. 12A showing close detail of the moveable side wall mechanism. FIG. 13A is an alternate view of the internal of a hygienic utensil dispenser showing the moveable side wall, and FIG. 13B is an enlarged view of FIG. 13A showing an alternate view of the internal of a hygienic utensil dispenser showing the movable side wall.

Figure 14A:
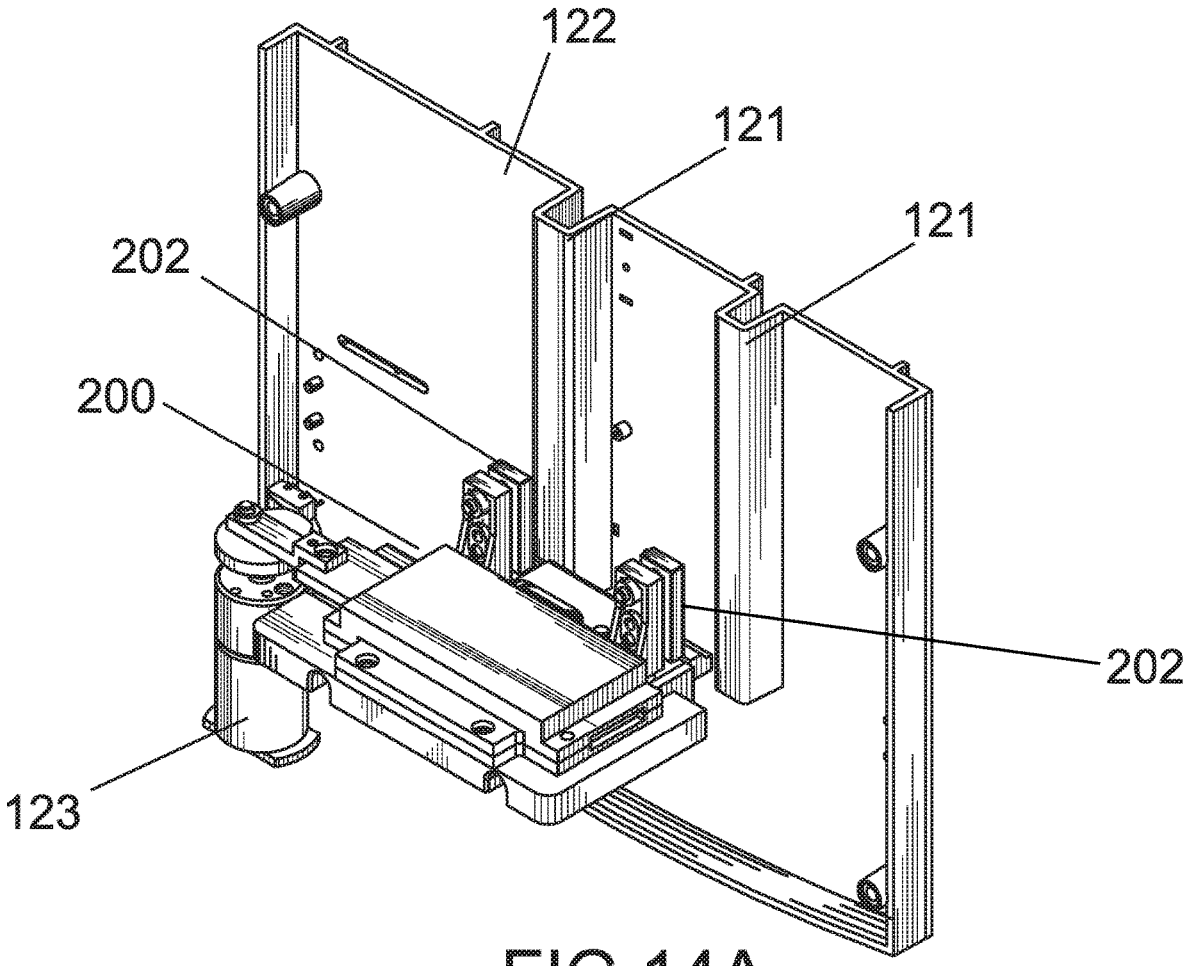
FIG. 14A is a front perspective view of the dispensing mechanism.
Figure 14B:
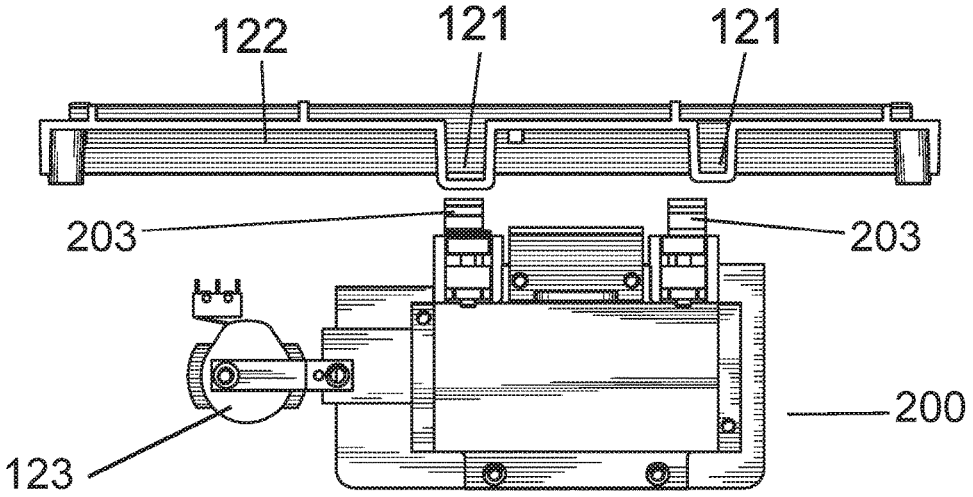
FIG. 14B is a top plan view of the dispensing mechanism.
Figure 15:
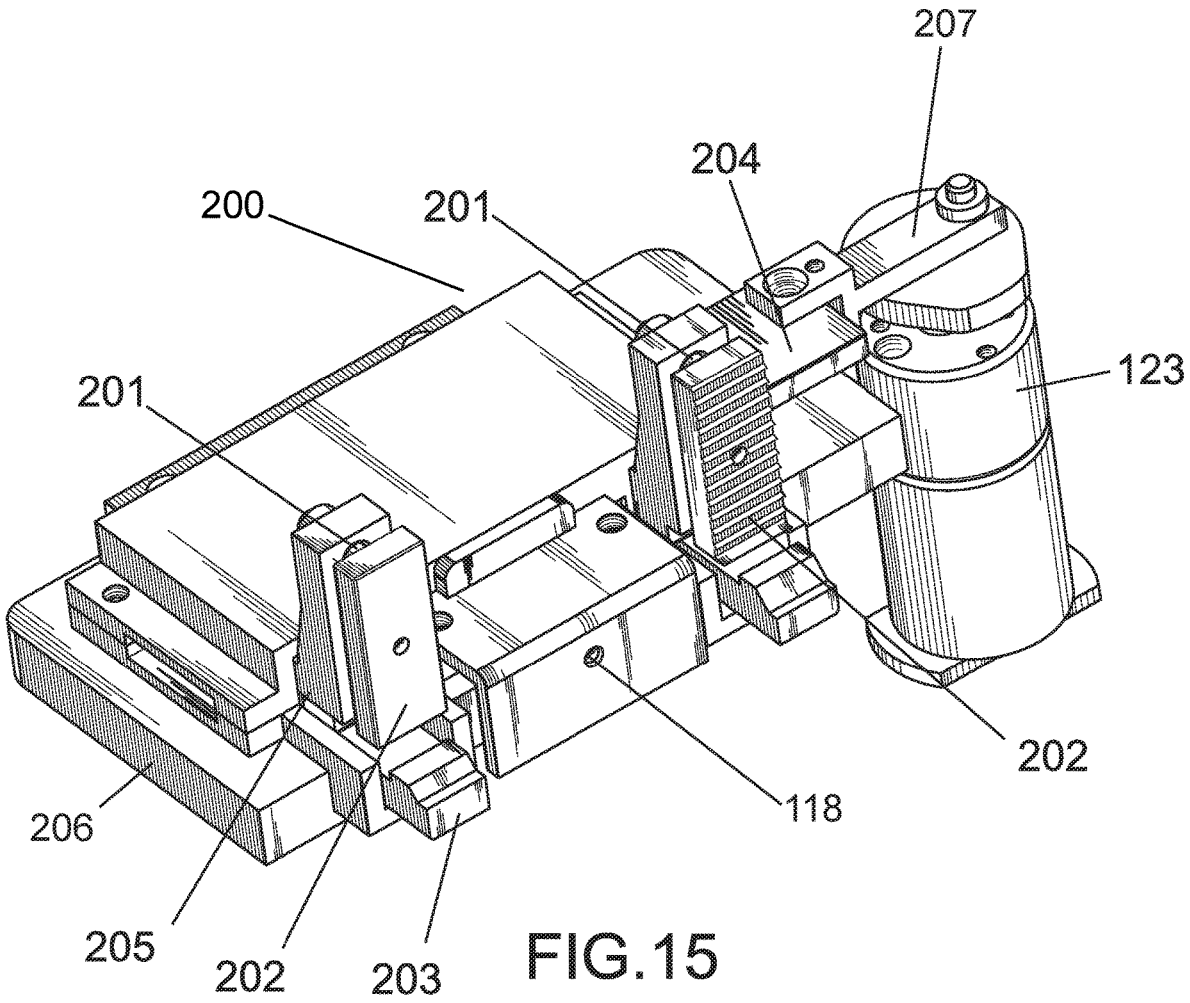
FIG. 15 is an alternate close up view of the dispensing mechanism.

FIGS. 14A and 14B show the dispensing mechanism of a preferred embodiment, without the utensil being present for a clear illustration of the structure. A plurality of rear columns 121 are molded out of the rear wall 122 of the utensil dispenser to provide support to the utensil stack. The structure of the mechanism comprises of a motor 123 connected to a middle plate 204 having a plurality of pins that sit on rails that dictate the motions of an upper plate 205 and a lower plate 206 as seen in FIG. 15. The upper plate is connected to the Pressure Pads 202, while the lower plate is connected to a plurality of dispensing teeth 203.

A plurality of Pressure Pads 202 provide a horizontal force toward the rear wall and perpendicular to the utensil stack to maintain the utensil stack's integrity while the bottom utensil is being dispensed. Without sufficient force to hold the utensil stack together, the cutleries within the stack may dislodge from one another, potentially creating a jam in the mechanism. The Pressure Pads 202 may be either textured or smooth, depending on the type of the utensil dispensed as seen on FIG. 15.

Figure 16A:
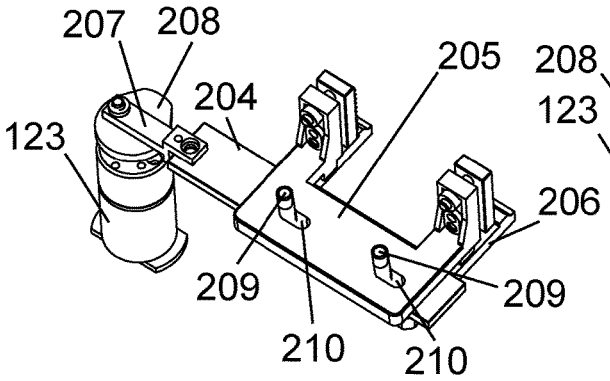
FIGS. 16A, 16B, 16C and 16D show the mechanical actions of the dispensing mechanism from alternate views.
Figure 16B:
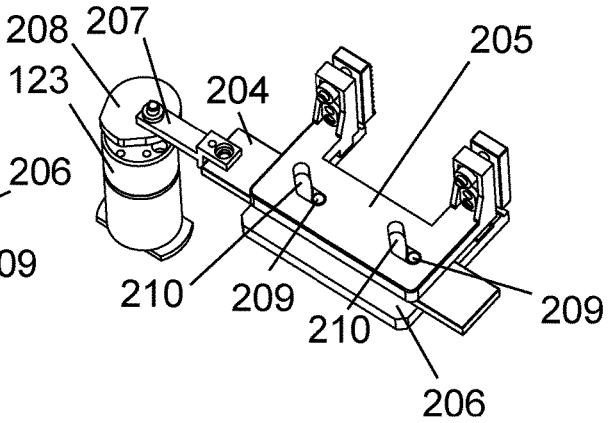
Figure 16C:
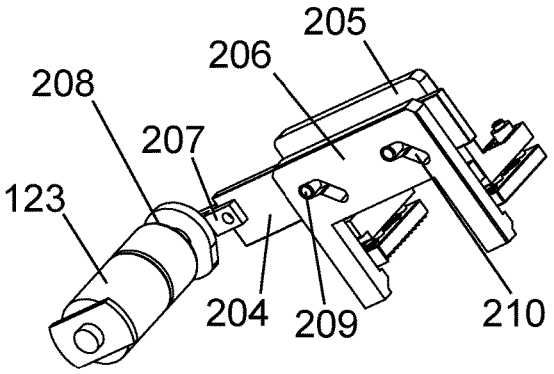
Figure 16D:
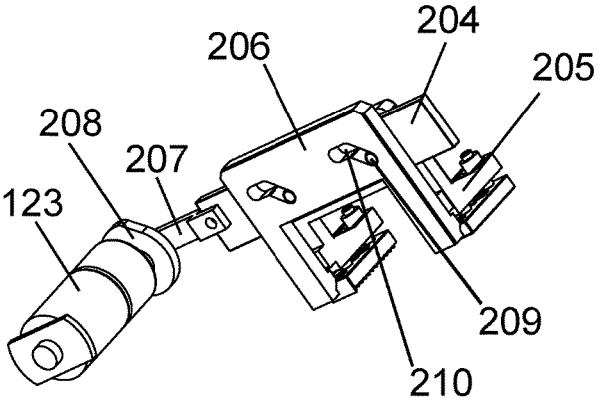
Figure 17:
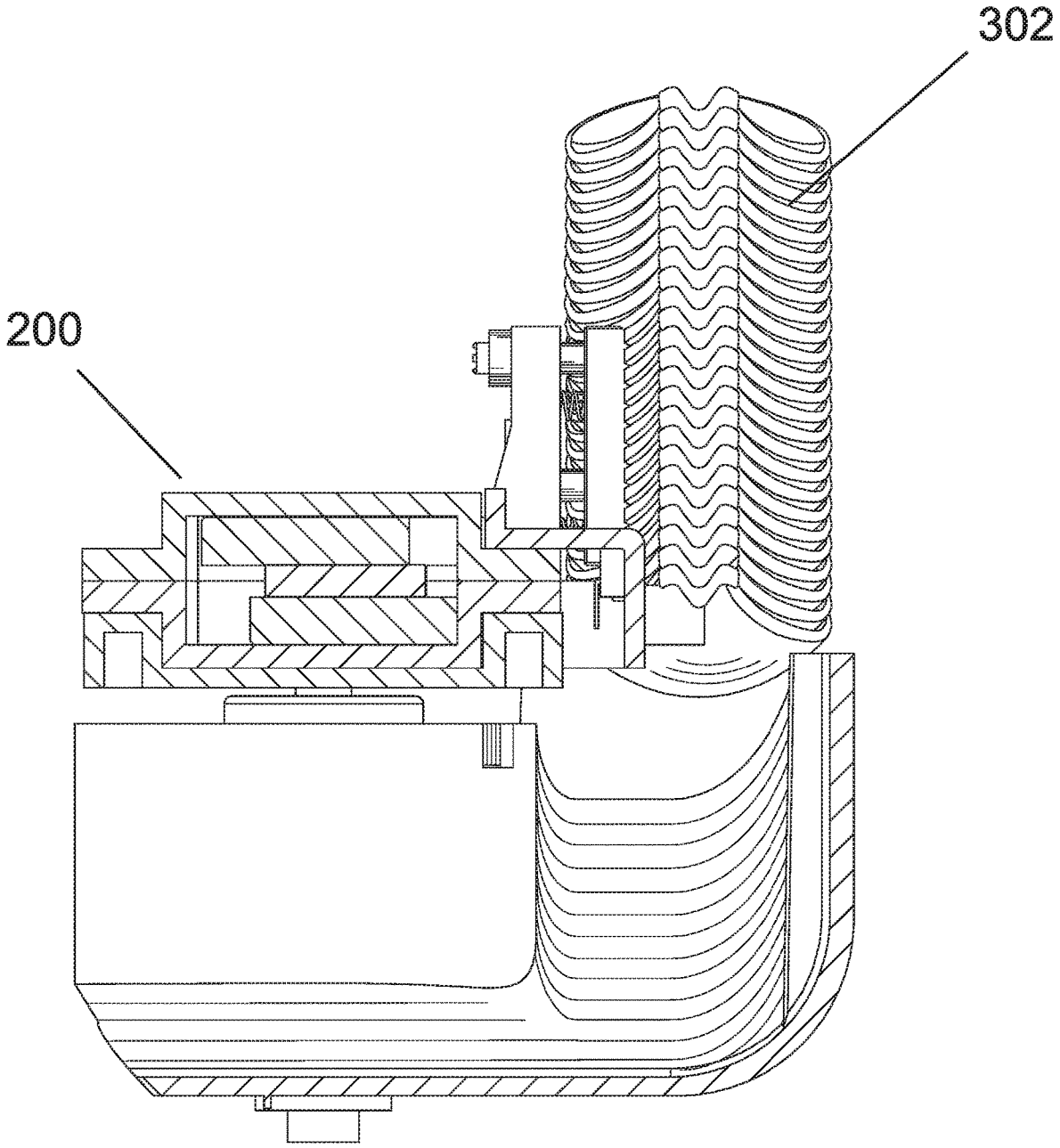
FIG. 17 is a cross sectional view of the dispensing mechanism interacting with a stack of utensil.
Figure 18A:
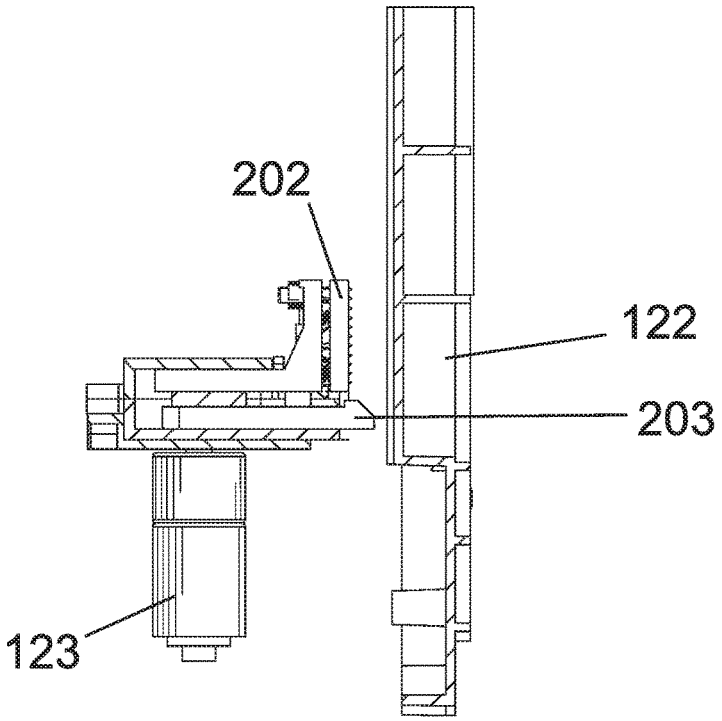
FIGS. 18A and 18B are side views of the dispensing mechanism sequence in action.
Figure 18B:
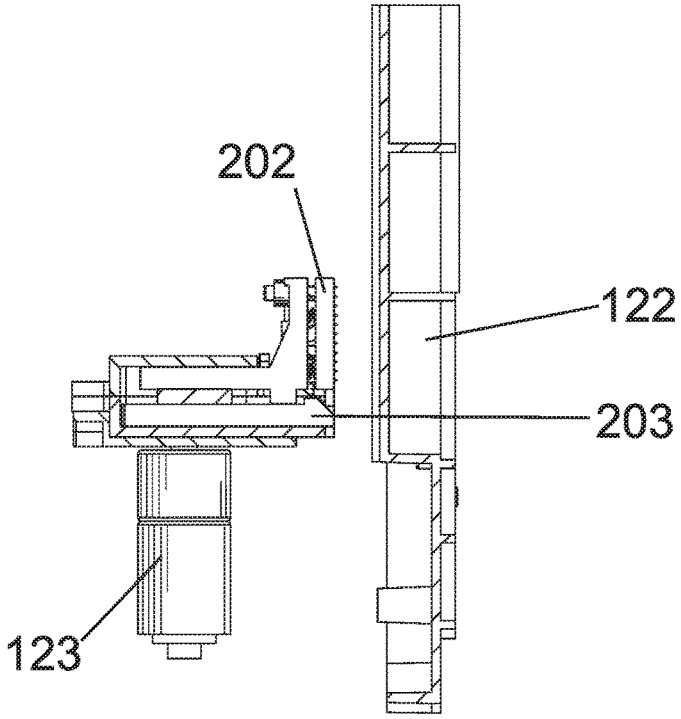
Figure 19A:
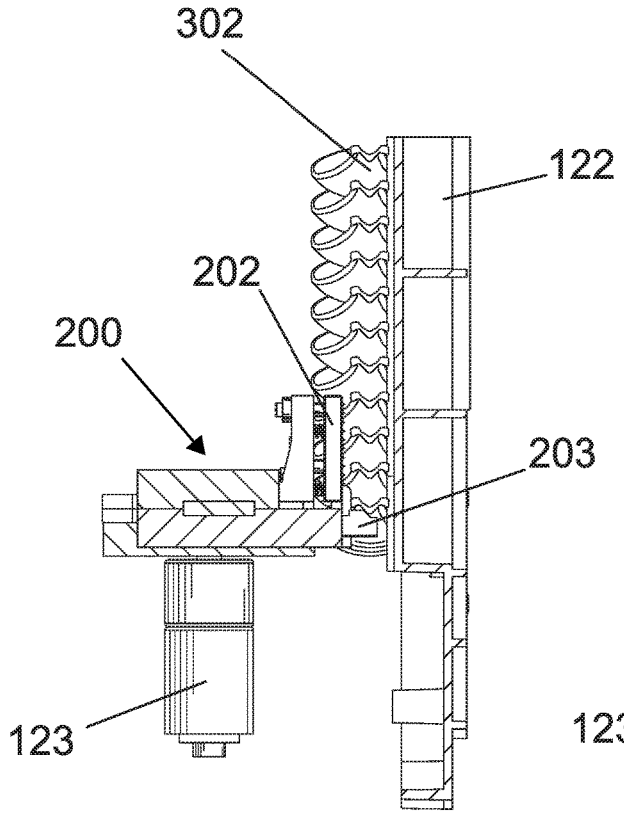
FIGS. 19A and 19B are side views of the dispensing mechanism sequence in action with a stack of utensil.
Figure 19B:
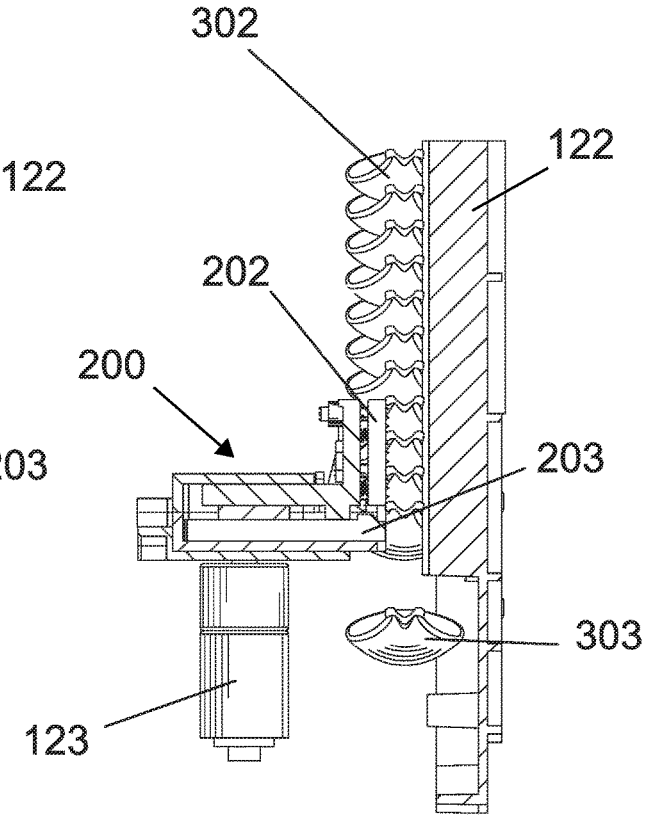

The dispensing mechanism follows a multi-step procedure, illustrated in FIGS. 16A and B and an alternate view shown in FIGS. 16C and D. In the initial state, where the utensil 303 is loaded to the dispenser and ready to be filled, the dispensing teeth 203 supports the bottom utensil that is about to be dispensed. On the first step, the motor lever plate 207 moves the middle plate 204 via the actuator 208 with the pins 209 such that the upper plate moves the Pressure Pads 202 toward the rear wall via the grooves 210, applying pressure to the utensil stack. On the second step, the lower plate 206 moves and retracts the dispensing teeth 203 toward the front of the dispenser. This allows the bottom utensil on the stack to be loose, and ready to be dispensed.

On the third step, the motor 123 moves further such that the lower plate 206 and the dispensing teeth move back to its original position. At this step, the dispensing teeth will end up between the bottom utensil and the utensil right above it, freeing the bottom utensil from the stack and dispensing it through the chute 119 below. Once the dispensing teeth return to its original position, the final step is achieved when the motor 123 moves the actuator 208 to its final position, by moving the upper plate 205 and pressure pad 202 to its original position, relieving pressure from the utensil stack. As the pressure is relieved, the utensil stack falls lower to the ready position and the cycle can be repeated until the low utensil sensor is triggered, as seen in FIGS. 18A and 18B, and FIGS. 19A and 19B. Note: FIGS. 18A, 18B, 19A, and 19B, show a version when the pressure pad 202 is in grooved configuration. When the low utensil sensor is triggered, the dispensing mechanism is disabled until the low utensil sensor is reset. This is done to prevent the dispensing mechanism from operating when there is no utensil to dispense, potentially damaging the mechanism. The low utensil sensor is reset by refilling the dispenser with utensils.

Figure 20A:
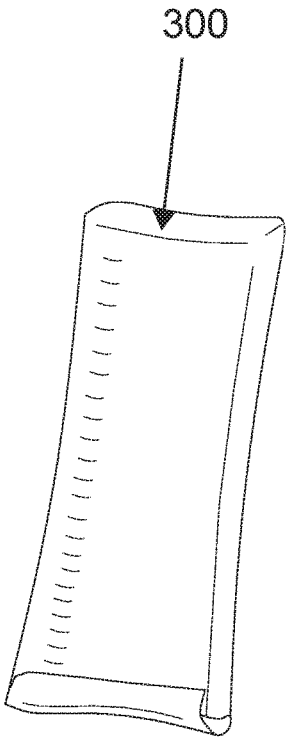
FIGS. 20A, 20B, and 20C are views of the sequences of unloading the utensil stack from its packaging.
Figure 20B:
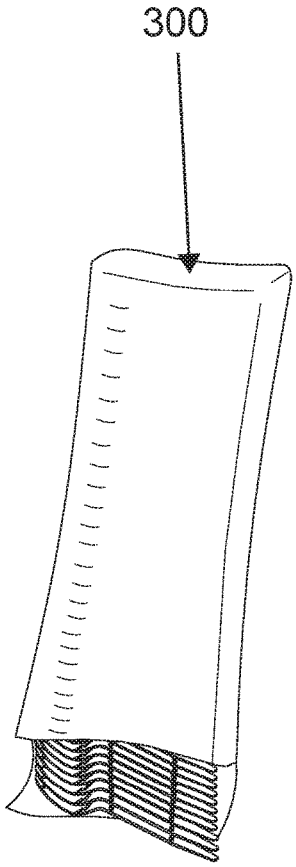
Figure 20C:
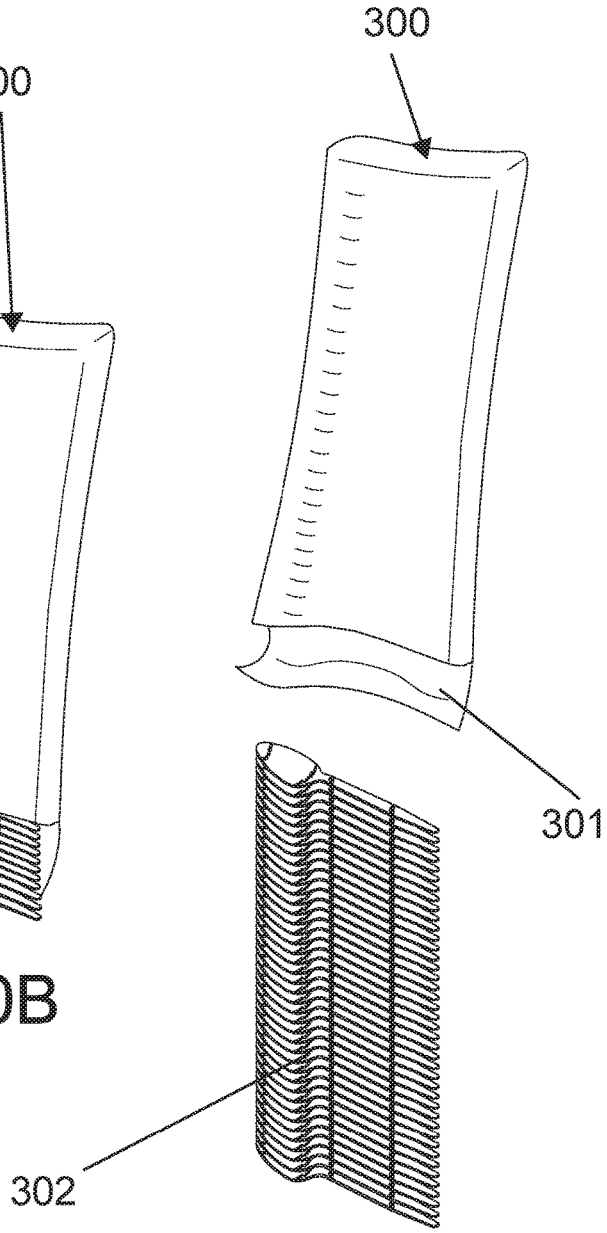

FIGS. 20A, 20B, and 20C are views of the sequences of unloading the utensil stack from its packaging, without the showing the dispenser for illustration purposes.

Figure 21:
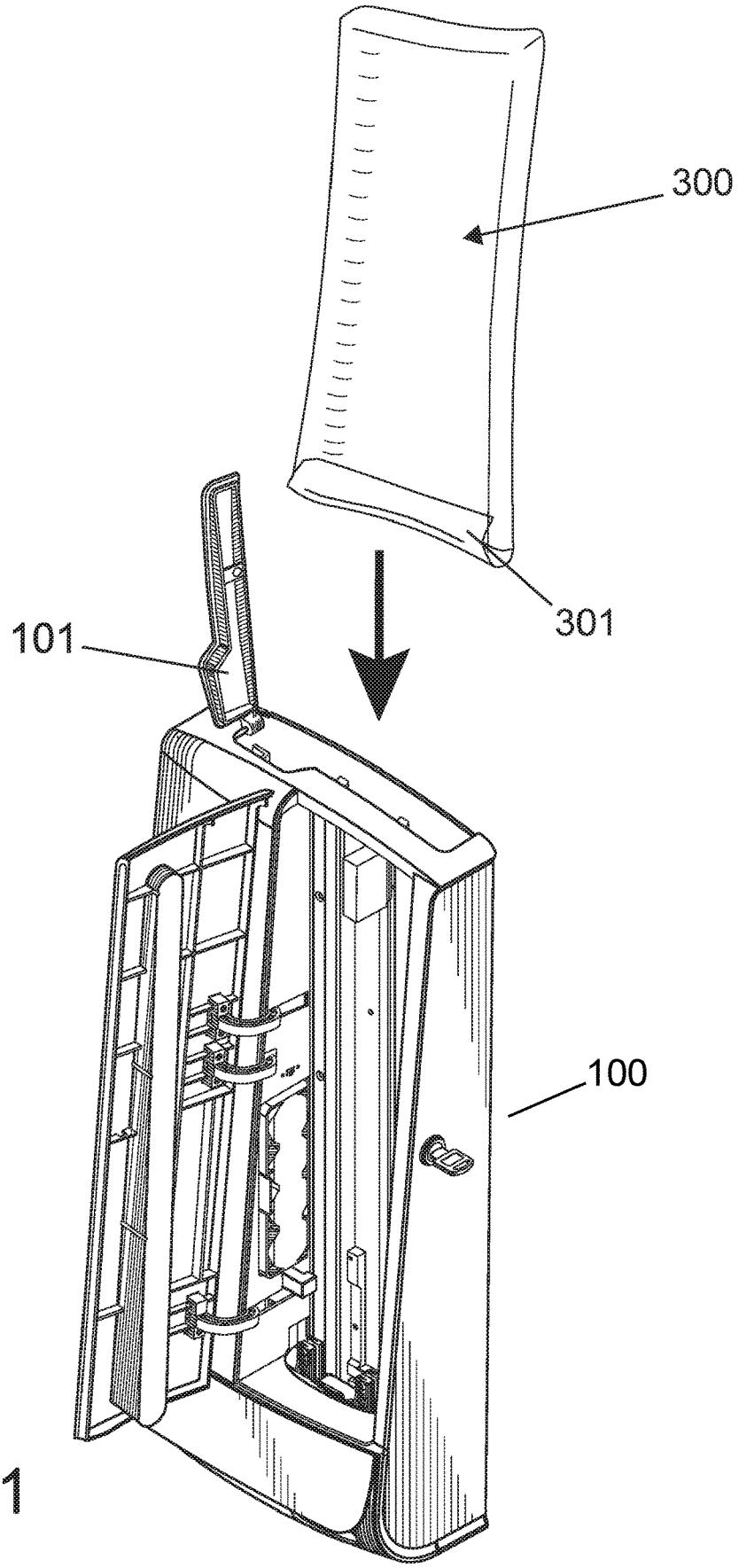
FIGS. 21-23 are views of the sequences of unloading the utensil stack from its packaging within the utensil dispenser.
Figure 22:
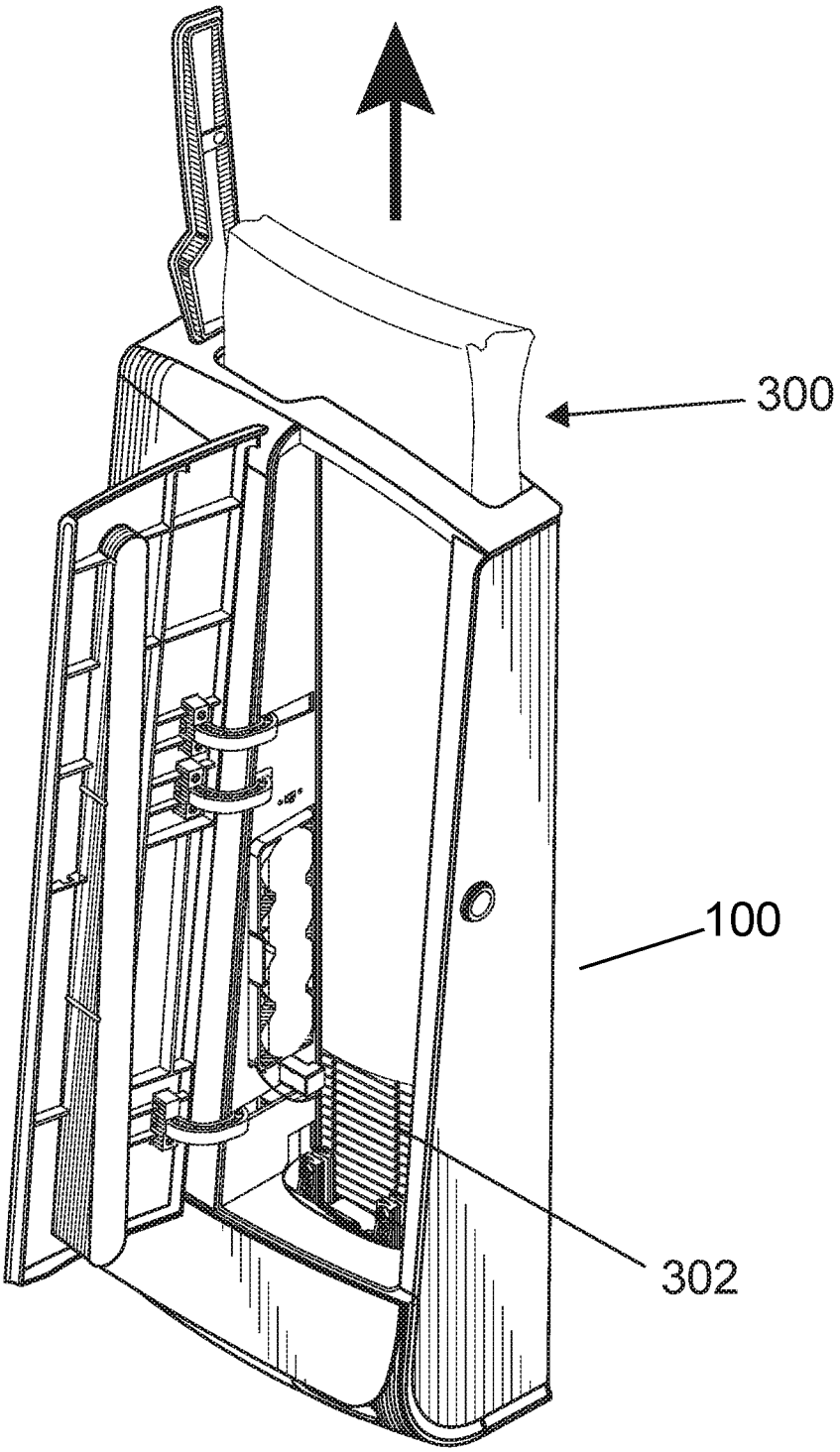
Figure 23:
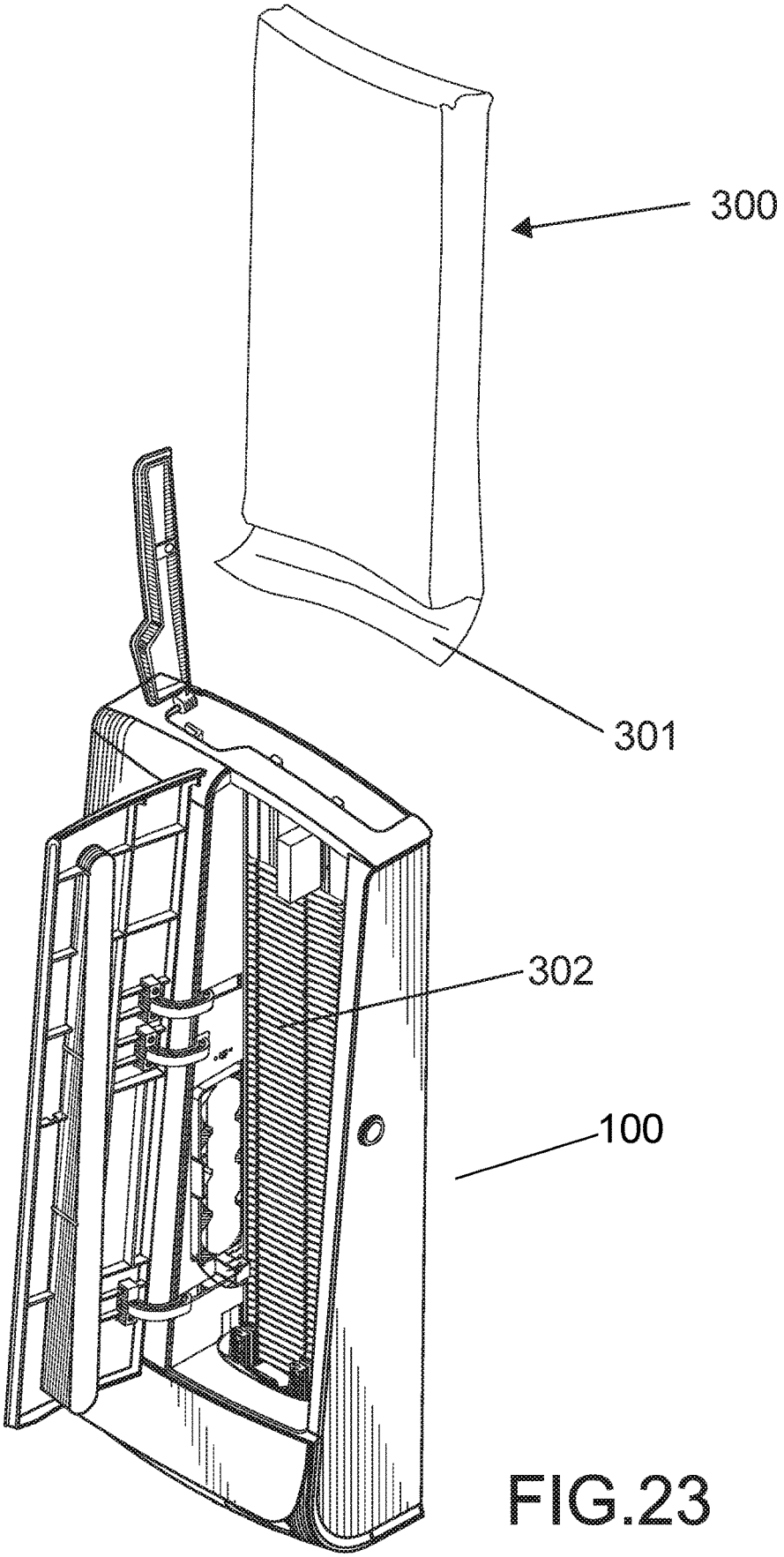

FIGS. 21-23 are views of the sequences of unloading the utensil stack from its packaging within the utensil dispenser. In one embodiment, the user opens the top loading door 101 of the dispenser when the front door is open. The user then loads the utensil stack that is still inside the sealed packaging 301 to the dispenser, with the opening of the packaging 302 oriented at the bottom as seen in FIG. 21. Once the majority of the stack is loaded in the dispenser, the user opens the packaging from the bottom, and pulls away the packaging toward the top loading door while simultaneous dropping the utensil stack into the chamber as seen in FIG. 22. The user can adjust the orientation and fit of the utensil stack by touching portions of the stack that are still covered in the packaging to prevent contaminating the utensil already loaded inside the dispenser. Once the utensil stack has been properly loaded, the user can clear the packaging from the dispenser as seen in FIG. 23. The user then closes the top loading door and the front door, and the dispenser is ready for use.

In one embodiment, a wireless device is provided within the dispenser to allow remote communications between the dispenser and a receiving device. The wireless device may be in the form of a short range wireless communication standard such Bluetooth, or a local area wireless technology such as Wi-Fi. The receiving device may be a proprietary device provided with the dispenser, an internet connected personal computing device, or a smart mobile device such as a smart phone or tablet. The information presented to the user can be accessed by means of a software application installed in the device used to receive the data from the dispenser.

The user can access a range of information from the dispenser, including but not limited to (1) low utensil alert, (2) number of utensil being dispensed in a given period, (3) number of times front door gets opened in a given period, (4) battery level, (5) name and/or ID of the dispenser to allow identification of individual dispenser on a given network, and (6) transmitting usage data back to the manufacturer, including amount dispensed, jam information, or maintenance/service status.

In the Summary of the Invention above and in the Detailed Description of the Invention, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm.

Although the present invention has been described in considerable detail with reference to certain preferred versions thereof, other versions are possible. Therefore, the spirit and scope of the appended claims should not be limited to the description of the preferred version contained herein.

We claim:

1. A method for loading a hygienic cutlery dispenser, comprising:

a. opening a top-loading door of a hygienic cutlery dispenser;

b. loading the hygienic cutlery dispenser with a hygienically sealed packaging bag of cutlery with a hygienic flap without a user touching said cutlery in its sealed package;

c. opening said hygienic flap and removing said sealed packaging, in its entirety, from the cutlery stack once the cutlery stack has been loaded in the hygienic cutlery dispenser by pulling said entirety of the packaging up towards the top-loading door thus opening the hygienic flap while said sealed packaging is contained within said dispenser and depositing the hygienic cutlery into the hygienic cutlery dispenser without the user touching said cutlery, and d. repeating steps a through c until the cutlery dispenser is fully refilled; and e. closing the door.

2. A method of claim 1, wherein opening the door requires unlocking a lock to open the said door of said hygienic cutlery dispenser.

3. A method of claim 1, wherein a stabilizing weight is used to keep the stack of cutlery aligned.

4. A method of claim 1, wherein a stabilizing weight is used to keep the stack of cutlery aligned and not for the dispensing action of cutlery.

5. A method of claim 1, wherein the opening of a bag of the hygienically sealed cutlery is the first exposure of hygienically packaged cutlery to the elements thereby maintaining the hygienic integrity of the hygienically sealed cutlery packaging until the hygienic flap is opened by the user when the hygienic bag is lifted out of the hygienic cutlery dispenser through the top-loading door.

* * * * *